US006357288B1

(12) United States Patent
Shigihama et al.

(10) Patent No.: US 6,357,288 B1
(45) Date of Patent: Mar. 19, 2002

(54) FAILURE DIAGNOSIS SYSTEM FOR EVAPORATION CONTROL SYSTEM

(75) Inventors: Shingo Shigihama; Katsuhiko Sakamoto; Yuji Ota; Tetsushi Hosokai, all of Aki-gun (JP)

(73) Assignee: Mazda Motor Corporation, Hiroshima-ken (JP)

( * ) Notice: Subject to any disclaimer, the term of this patent is extended or adjusted under 35 U.S.C. 154(b) by 0 days.

(21) Appl. No.: 09/535,841

(22) Filed: Mar. 28, 2000

(30) Foreign Application Priority Data

Mar. 29, 1999 (JP) ..... 11-086087

(51) Int. Cl.[7] ..... F02M 25/08
(52) U.S. Cl. ..... 73/118.1; 73/49.2; 73/49.7
(58) Field of Search ..... 73/40, 49.2, 49.7, 73/118.1; 701/31; 123/519, 520

(56) References Cited

U.S. PATENT DOCUMENTS 5,317,909 A 6/1994 Yamada et al. ..... 73/118.1
5,408,866 A * 4/1995 Kawamura et al. ..... 73/118.1
5,467,641 A * 11/1995 Williams et al. ..... 73/49.7
5,671,718 A * 9/1997 Curran et al. ..... 123/520
5,898,108 A * 4/1999 Mieczkowski et al. .... 73/118.1
6,016,690 A * 1/2000 Cook et al. ..... 73/49.2
6,044,314 A * 3/2000 Cook et al. ..... 701/31
6,073,487 A * 6/2000 Dawson ..... 73/118.1

FOREIGN PATENT DOCUMENTS

JP 5-125997 5/1993

* cited by examiner

*Primary Examiner*—George Dombroske
(74) *Attorney, Agent, or Firm*—Brooks & Kushman P.C.

(57) ABSTRACT

A system for diagnosing evaporation control system failures repeatedly introduces pressure, positive or negative, into the evaporation control system and closes up it hermetically, a plurality of times (for example two times), and detects changes in internal pressure in the evaporation control system. An average value of the internal pressure changes is compared to a threshold value so as to judge whether there is leakage of fuel vapors of the evaporation control system. When a difference between the internal pressure change is greater than a specified value, the evaporation control system failure diagnosis is interrupted.

17 Claims, 22 Drawing Sheets

FAILURE DIAGNOSIS SYSTEM FOR EVAPORATION CONTROL SYSTEM

BACKGROUND OF THE INVENTION

1. Field of the Invention

The present invention relates to a failure diagnosis system for an evaporation control system of an automotive vehicle.

2. Description of Related Art

Typically, automobile engines are equipped with evaporation control systems that store fuel tank vapors in a vapor storage canister and supply fuel vapors into a fuel system of the engine. Such an evaporation control system includes a fuel vapor canister for temporary storage of fuel vapors and a purge control valve which is opened to purge fuel vapors in the fuel vapor canister into the fuel system when the engine operates in a specified range of operating conditions. If there is leakage in the evaporation control system between a fuel tank and the vapor storage canister with the purge control valve, it is hard to prevent fuel vapors from escaping into the atmosphere. Therefor, it is typical to make a fuel leakage diagnosis of fuel vapors of the evaporation control system.

A diagnosis of fuel vapor leakage of the evaporation control system is made on the basis of a change in internal pressure of the evaporation control system produced during or after depressurization of the evaporation control system with intake air into the engine which is caused by opening the purge control valve. Such a fuel vapor leakage diagnosis is known from, for example, Japanese Unexamined Patent Publication No. 5-125997 which corresponds to U.S. Pat. No. 5,317,909, entitled "Abnormality Detecting Apparatus for Use in Fuel Transpiration Prevention System".

In recent years, there is a strong demand for increasing a chance to implement the diagnosis of failure of the evaporation control system and detecting quite small leakage of fuel vapors. On the other hand, there is a possibility of making a wrong diagnosis because a change in internal pressure of the closed-up evaporation control system that is caused due to small leakage of fuel vapors in the evaporation control system is very small. In particular, a change in the internal pressure of the closed-up evaporation control system is affected by various factors such as the amount of fuel vapors, the temperature of fuel vapors, the amount of remaining liquid fuel, etc. as well as fuel vapor leakage. In light of this, it is thought to limit implementation of the diagnosis of small leakage of fuel vapors to cases where the evaporation control system causes no great change in internal pressure due to factors other than fuel vapor leakage. However, in such a case, a chance to implement the fuel vapor leakage diagnosis considerably diminishes.

SUMMARY OF THE INVENTION

It is therefore an object of the present invention to provide a failure diagnosis system for an evaporation control system which makes a fuel vapor leakage diagnosis with a high accuracy while providing a chance to diagnose small leakage of fuel vapors of the evaporation control system increased as much as possible.

In order to achieve the foregoing object of the present invention, according to a preferred embodiment of the present invention, a system for diagnosing failures of an evaporation control system on the basis of a change in internal pressure, negative or positive, of the evaporation control system that is closed up hermetically repeatedly introduces pressure into the evaporation control system and closes up the evaporation control system hermetically and makes a judgement that the evaporation control system causes leakage of fuel vapor on the basis of a plurality of changes in internal pressure of the evaporation control system that occur while the evaporation control system is closed up hermetically The evaporation control system failure diagnosis system may evade the judgement when a difference between the changes in internal pressure of the evaporation control system is greater than a specified value.

According to another preferred embodiment of the present invention, the evaporation control system failure diagnosis system implements a diagnosis of first type failures such as large leakage of fuel vapors of the evaporation control system in a specified region that is defined with at least engine speed and engine load as parameters when a first diagnostic condition which is determined on the basis of parameters relating to driving conditions is satisfied and a diagnosis of second type failures such as small leakage of fuel vapors of the evaporation control system in the specified region on condition that the vehicle travels in an ordinary driving condition in which changes in the parameters are small when a second diagnostic condition which is determined on the basis of said parameters is satisfied. In this instance, each diagnosis of the first and second type failures is implemented on condition that a specified fuel condition relating to an amount of liquid fuel remaining in a fuel tank is satisfied; and the specified fuel condition is determined so that the diagnosis of second type failures is harder to implement than the diagnosis of first type failures.

According to still another preferred embodiment of the present invention, the evaporation control system failure diagnosis system implements the first diagnosis of first type failures on the basis of only one of the changes in internal pressure of the evaporation control system during engine idling on condition that an amount of fuel vapors generated before introducing pressure into the evaporation control system is small and the diagnosis of second type failures on the basis of a plurality of the changes in internal pressure of the evaporation system during engine off-idling.

Implementing the evaporation control system failure diagnosis on the basis of a plurality of changes in internal pressure of the evaporation control system provides an accurate evaporation control system failure diagnosis as compared with implementation of the evaporation control system failure diagnosis on the basis of a single change in internal pressure of the evaporation control system. Moreover, since implementation of the evaporation control system failure diagnosis is evaded when a difference between changes in internal pressure of the evaporation control system is greater than a specified value on the grounds that there is a possibility of an occurrence of some of such changes in internal pressure of the evaporation control system due to causes other than leakage of fuel vapors, the evaporation control system failure diagnosis is implemented far more accurately. Further, evading implementation of the evaporation control system failure diagnosis eliminates it to provide considerably hard conditions for implementation of the evaporation control system failure diagnosis, which is desirable in order to ensure an increased chance to implement the diagnosis of failure of the evaporation control system.

Separately implementing diagnoses of first and second type failures such as large and small leakage of fuel vapors of the evaporation control system also ensures a chance to implement the diagnosis of failure of the evaporation control system and provides appropriate diagnoses according levels of leakage of fuel vapors. The diagnosis of first type failures, namely large leakage of fuel vapors, is not affected so much by rises in internal pressure of the evaporation control system due to causes other than leakage of fuel vapors, so that wrong diagnoses are avoided and diagnoses are rapid. Further, employing a specified amount of liquid fuel remaining in the fuel tank as one of the conditions for implementation of the evaporation control system failure diagnosis is desirable to avoid wrong diagnoses. In addition, making the specified fuel condition so that the diagnosis of second type failures is harder to implement than the diagnosis of first type failures is desirable to prevent wrong diagnoses of small leakage of fuel vapors.

Implementation of the evaporation control system failure diagnosis during off-idling, i.e. during traveling of the vehicle provides an increased chance to implement the diagnosis of failure of the evaporation control system. Further, implementation of the evaporation control system failure diagnosis both during off-idling and during idling, provides a far more increased chance to implement the diagnosis of failure of the evaporation control system. Further, it is desirable not only in order to perform simply and rapidly diagnoses of failures of the evaporation control system but also in order to perform accurately diagnoses of failures of the evaporation control system to implement the evaporation control system failure diagnosis on the basis of a single change in internal pressure of the evaporation control system during idling and evade it when the amount of fuel vapors generated in the fuel tank is large before introduction of pressure into the fuel tank. Moreover, implementing the evaporation control system failure diagnosis on the basis of a plurality of changes in internal pressure of the evaporation control system during off-idling provides a far more accurate diagnosis as compared with implementation of the evaporation control system failure diagnosis on the basis of a single change in internal pressure of the evaporation control system.

BRIEF DESCRIPTION OF THE DRAWINGS

The above and other objects and features of the present invention will become more clear from the following detailed description of the preferred embodiments when reading in conjunction with the accompanying drawings, in which.

DETAILED DESCRIPTION OF THE PREFERRED EMBODIMENTS

Figure 1:
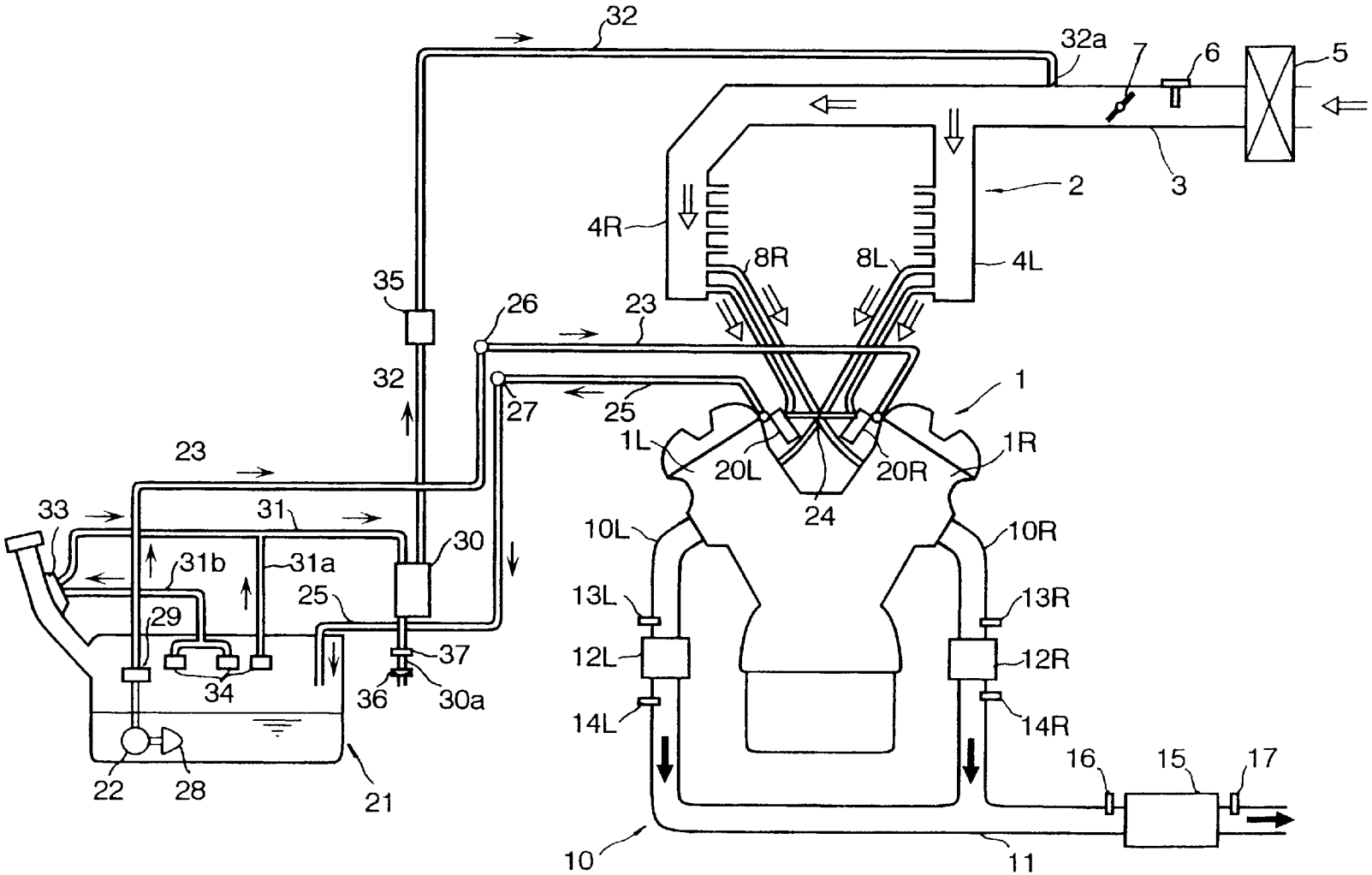
FIG. 1 is a schematic view showing an evaporation control system with a failure diagnosis system in accordance with an embodiment of the present invention.

Referring to the drawings in detail and, in particular, to FIG. 1 which shows a six-cylinder V-type engine 1 equipped with a evaporation control system having an evaporation control system, the engine comprises left or first cylinder bank 1L and a right or second bank 1R arranged in a V-formation with a predetermined relative angle of, for example, 60°. A row of three cylinders (not shown) are formed in the left cylinder bank 1L. Similarly, a row of three cylinders (not shown) are formed in the right cylinder bank 1R. The engine 1 has an air intake system 2 comprising a single common intake pipe 3 and right and left surge tanks 4R and 4L forming two parallel intake pipes branching off from the common intake pipe 3. The common intake pipe 3 is provided, in order from the upstream end toward the downstream end, an air cleaner 5, an air-flow sensor 6 and a throttle valve 7. The cylinders in the left cylinder bank 1L are separately communicated with the left surge tank 4L by way of left discrete intake pipes 8L. Similarly, the cylinders in the right cylinder bank 1R are separately communicated with the right surge tank 4R by way of right discreteintake pipes 8R. Each of the cylinders has two intake ports. One of the intake ports of each cylinder is connected to the left discrete intake pipe 8L, and another intake port of the cylinder is connected to the right discrete intake pipe 8R. Therefore, each cylinder is supplied with intake air from both right and left surge tanks 4R and 4L. The right and left discrete intake pipes 8R and 8L for each cylinder are configured such that either one of them is closed so as to introduce intake air from the surge tank connected to the cylinder through another discrete intake pipe in a specific range of driving conditions such as high engine speeds and high engine loads in which there is a strong demand for high engine output torque. Specifically, in this embodiment, intake air is introduced into the cylinder formed in the left cylinder bank 1L through the left surge tank 4L only in the specific range of driving conditions. Similarly, intake air is introduced into the cylinder formed in the right cylinder bank 1R through the right surge tank 4R only in the specific range of driving conditions.

The engine 1 also has an exhaust system 10 comprising right and left exhaust pipes 10R and 10L. The right exhaust pipe 10R at its upstream end braches off into right discrete pipes (not shown) by way of which the cylinders formed in the right cylinder bank 1R are separately communicated with the right exhaust pipe 10R. Similarly, the left exhaust pipe 10L at its upstream end branches off into left discrete pipes (not shown) by way of which the cylinders formed in the left cylinder bank 1R are separately communicated with the left exhaust pipe 10L. These right and left exhaust pipes 10R and 10L at their downstream ends merge a common exhaust pipe 11. The right exhaust pipe 10R is provided with an exhaust gas purifying catalyst such as a three-way catalyst 12R and oxygen ($O_2$) sensors 13R and 14R arranged upstream and downstream from the three-way catalyst 12R in order to monitor air-fuel ratio. Similarly, the left exhaust pipe 10L is provided with an exhaust gas purifying catalyst such as a three-way catalyst 12L and oxygen ($O_2$) sensors 13L and 14L arranged upstream and downstream from the three-way catalyst 12L in order to monitor air-fuel ratio. Further, the common exhaust pipe 11 is provided with an exhaust gas purifying catalyst such as a three-way catalyst 15 and oxygen ($O_2$) sensors 16 and 16 arranged upstream and downstream from the three-way catalyst 15 in order to monitor air-fuel ratio. The oxygen ($O_2$) sensor 13R, 14R provides an air-fuel ratio signal on the basis of an oxygen concentration of exhaust gas. Deterioration of the three-way catalyst 12R is detected by comparing outputs from the oxygen ($O_2$) sensors 13R and 14R. Deterioration of the three-way catalyst 12L is detected by comparing outputs from the oxygen ($O_2$) sensors 13L and 14L. Similarly, deterioration of the three-way catalyst 15 is detected by comparing outputs from the oxygen ($O_2$) sensors 16 and 17. The utilization is made of the oxygen ($O_2$) sensor 13R for air-fuel ratio feedback control of the cylinders formed in the right cylinder bank 1R and of the oxygen ($O_2$) sensor 13L for air-fuel ratio feedback control of the cylinders formed in the left cylinder bank 1L.

The right discrete intake pipes 8R into which intake air is always introduced regardless of driving conditions are provided with fuel injectors 20R, respectively. Similarly, the left discrete intake pipes 8L into which intake air is always introduced regardless of driving conditions are provided with fuel injectors 20L, respectively. A fuel system delivers fuel that is drawn up from a fuel tank 21 by a fuel pump 22 and supplied to the fuel injectors 20R through a fuel pipe 23, and thereafter to the fuel injectors 20L through a communication fuel pipe 24. Surplus fuel is returned to the fuel tank 21 through a return fuel pipe 25. The fuel pipe 23 is provided with a pulsation damper 26 and filters 28 and 29 which are disposed in close proximity to the fuel pump 22. The return fuel pipe 25 is provided with a regulator 27 operative to regulate the pressure of fuel. A fuel vapor system includes a canister 20 that is operative to spontaneously store fuel vapors therein. The canister 20 is connected to the fuel tank 21 through an introduction pipe 31 and to the common intake pipe 3 upstream from the throttle valve 7 through a purge pipe 32. The purge pipe 32 opens to the common intake port 3 at an inlet 32*a*. The introduction pipe 31 branches off into two branch pipes 31*a* and 31*b*. The branch pipe 31*a* opens to a space in the interior of the fuel tank 21. The branch pipe 31*b* is provided with a mechanical valve 33 and has an end portion branching off into two inlets which open to the space in the interior of the fuel tank 21. The branch pipes 31*a* and 31*b* are provided with cut valves 34 which are disposed at their inlets and closed by liquid fuel in the fuel tank 21. The mechanical valve 33 is closed by a refueling pump nozzle (not shown) inserted into a refueling inlet of the fuel tank 21. The purge pipe 32 is provided with a purge control valve 35 which is of electromagnetically controlled continuously variable type. The canister 30 is provided with an air duct 30*a* to which a filter 36 and an electromagnetically operated atmosphere release valve 37 are connected. Fuel vapors in the fuel tank 21 are delivered to the canister 30 through the introduction pipe 31 while the purge control valve 35 remains closed and spontaneously stored therein. On the other hand, while both purge control valve 35 and atmosphere release valve 37 remain open during ordinary engine operation, the fuel vapors are purged from the canister 30 and delivered into the common intake pipe 3 through the purge pipe 32 and finally introduced into the cylinders.

Figure 2:
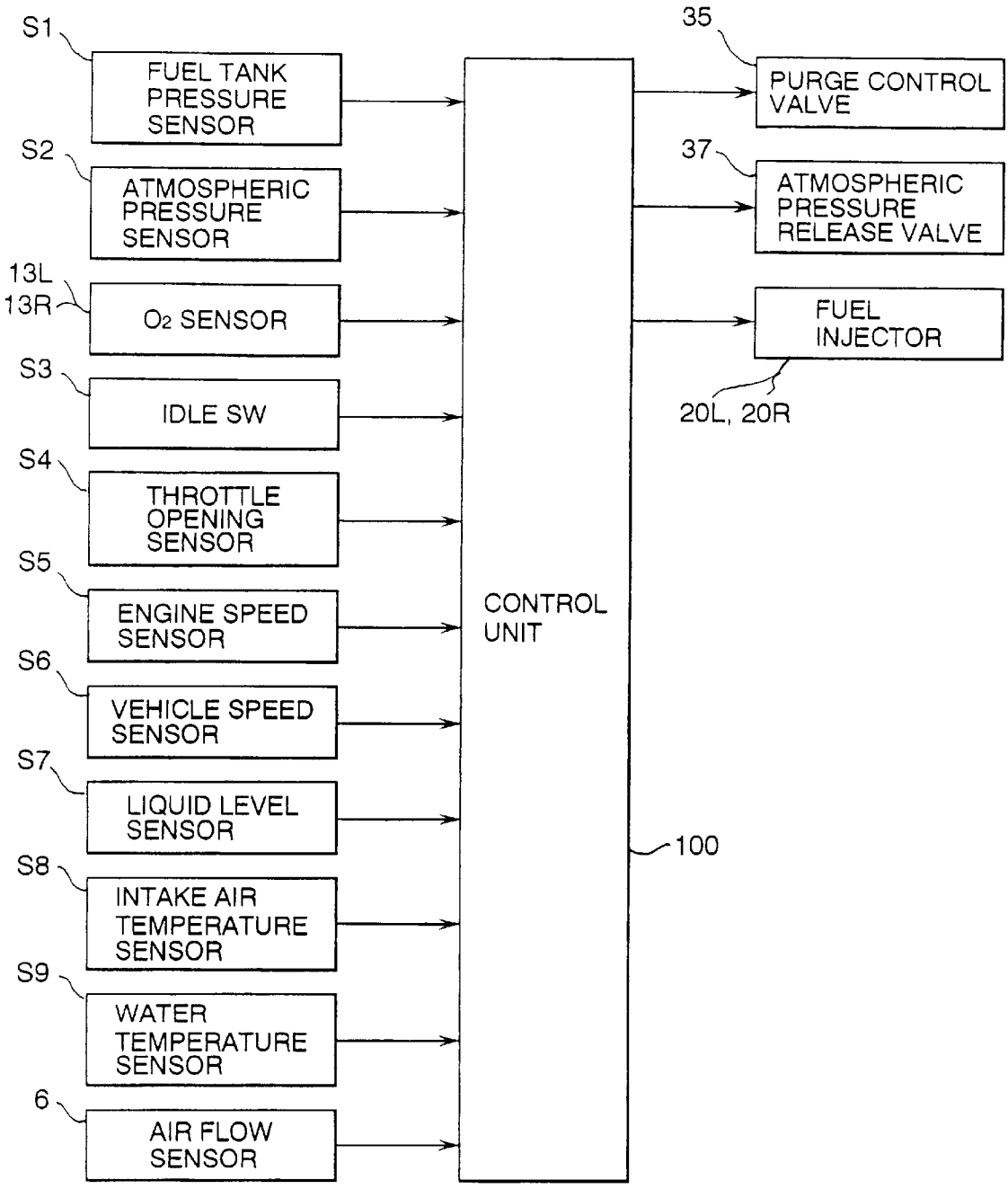
FIG. 2 is a block diagram showing a control system of the failure diagnosis system.

FIG. 2 is a schematic block diagram illustrating air-fuel ratio feedback control and evaporation control system failure diagnosis which are implemented by a control unit 100 mainly comprising a microcomputer. Various sensors and switches S1–S9 for providing signals representative of various control parameters, which include the oxygen ($O_2$) sensors 13R and 14R and the air-flow sensor 6 are connected to the control unit 100. The sensors and switches include, besides the oxygen ($O_2$) sensors 13R and 14R and the air-flow sensor 6, at least a pressure sensor S1 for detecting an internal pressure of the fuel tank 21 (which is hereafter referred to as a fuel tank internal pressure) and providing a tank pressure signal, an atmospheric pressure sensor S2 for detecting atmospheric pressure and providing an atmospheric pressure signal, an idle switch S3 operative to turn on when an accelerator pedal is in a closed position and provide an idling signal which indicates that the engine is idling, a throttle sensor S4 for detecting a valve opening or valve opening of the throttle valve 7 and providing a valve opening signal, an engine speed sensor S5 for detecting an engine speed of rotation and providing an engine speed signal, a vehicle speed sensor S6 for detecting a vehicle speed and providing a vehicle speed signal, a liquid level sensor S7 for detecting a level of fuel liquid that remains in the fuel tank 21 and providing a signal representative of an available amount of liquid fuel, a temperature sensor S8 for detecting intake air temperature and providing an intake air temperature signal, and a temperature sensor S9 for detecting engine coolant temperature and providing an engine coolant temperature signal.

The air-fuel feedback control is implemented on the basis of signals from the oxygen ($O_2$) sensors 13R and 14R also during engine idling. Each of the oxygen ($O_2$) sensors 13R and 14R is of a type that provides an output which is reversed before and after a stoichiometric air-fuel ratio as a boundary. The control unit 100 increases an amount of fuel that is sprayed through the fuel injector 20L, 20R for correction when the oxygen ($O_2$) sensor 13R, 14R provides an air-fuel ratio signal indicating that a fuel mixture is leaner than a stoichiometric fuel mixture or increases an amount of fuel that is sprayed through the fuel injector 20L, 20R for correction when the oxygen ($O_2$) sensor 13R, 14R provides an air-fuel ratio signal indicating that a fuel mixture is richer than a stoichiometric fuel mixture, so as thereby to feedback control to bring the air-fuel ratio toward a stoichiometric air-fuel ratio. The evaporation control system failure diagnosis for diagnosing failures, such as leakage of fuel vapors, of the evaporation control system is implemented in predetermined three diagnostic modes, namely A-, B- and C-diagnostic modes. The A-diagnostic mode is prepared in order to detect small leakage of fuel vapors which occurs through a small hole with a diameter of approximately 0.02 inches and takes place during implementation of the air-fuel ratio feedback control when the engine is idling. The B-diagnostic mode is prepared in order to detect small leakage of fuel vapors which occurs through a small hole with a diameter of approximately 0.02 inches and takes place whenever the engine is idling. The C-diagnostic mode is prepared in order to detect relatively large leakage of fuel vapors which occurs through a relatively large hole with a diameter of approximately 0.04 inches or occurs due to separation of a pipe joint and takes place during off-idling engine operation. Conditions common to the A-, B- and C-diagnostic modes on which the evaporation control system failure diagnosis is implemented are as follows:

The lowest intake air temperature is higher than a specified limit;

No large leakage of fuel vapors is detected;

There is a specified difference of the lowest intake air temperature from an engine coolant temperature at an engine start;

There is no indication of extraordinary pressure;

An intake air temperature is within a specified extent;

A specified amount of liquid fuel remains in the fuel tank;

The fuel tank internal pressure is higher than a specified level;

The atmospheric pressure is higher than s specified level;

The vehicle speed is higher than a specified speed:

An engine coolant temperature is within a specified extent at an engine start.

Conditions on which the evaporation control system failure diagnosis is implemented in the A-diagnostic mode are as follows:

The common conditions are satisfied;

The evaporation control system failure diagnosis has not yet been implemented in the A-diagnostic mode;

The idle switch S3 remains turned on (the engine is idling);

The engine speed is higher than a specified speed;

Fluctuations in liquid level are small (fluctuations of a signal representative of an available amount of liquid fuel is small);

The available amount of liquid fuel is greater than a specified valve;

A duration of travel at speeds higher than a specified speed is longer than a specified time;

A retrial counter has not yet counted up;

The engine coolant temperature is within a specified extent;

The engine coolant temperature is lower than a specified temperature at an engine start;

A time after an engine start is less than a specified value.

Conditions on which the evaporation control system failure diagnosis is implemented in the B-diagnostic mode are as follows:

The common conditions are satisfied;

The evaporation control system failure diagnosis has not yet been implemented in the B-diagnostic mode;

The throttle valve opening is within a specified extent;

Charging efficiency is within a specified extent;

The engine speed is within a specified extent;

The vehicle speed is within a specified extent;

Fluctuations in liquid level are small (fluctuations of a signal representative of an available amount of liquid fuel is small);

An available amount of liquid fuel is greater than a specified valve;

A specified period of time has passed after a point of time at which a specified vehicle traveling speed has been exceeded;

A retrial counter has not yet counted up;

An engine coolant temperature is within a specified extent;

A changing rate of throttle valve opening is smaller than a specified value;

A changing rate of vehicle speed is smaller than a specified value;

The engine coolant temperature is lower than a specified temperature at an engine start;

A time lapse after an engine start is less than a specified value.

Conditions on which the evaporation control system failure diagnosis is implemented in the C-diagnostic mode are as follows:

The common conditions are satisfied;

The evaporation control system failure diagnosis has not yet been implemented in the C-diagnostic mode;

A throttle delay timer has not yet counted up;

Charging efficiency is within a specified extent;

The engine speed is within a specified extent;

The vehicle speed is higher than a specified speed;

Fluctuations in liquid level are small (fluctuations of a signal representative of an available amount of liquid fuel is small);

The retrial counter has not yet counted up;

The engine coolant temperature is within a specified extent;

A time lapse after an engine start has exceeded a specified time.

Figure 3:
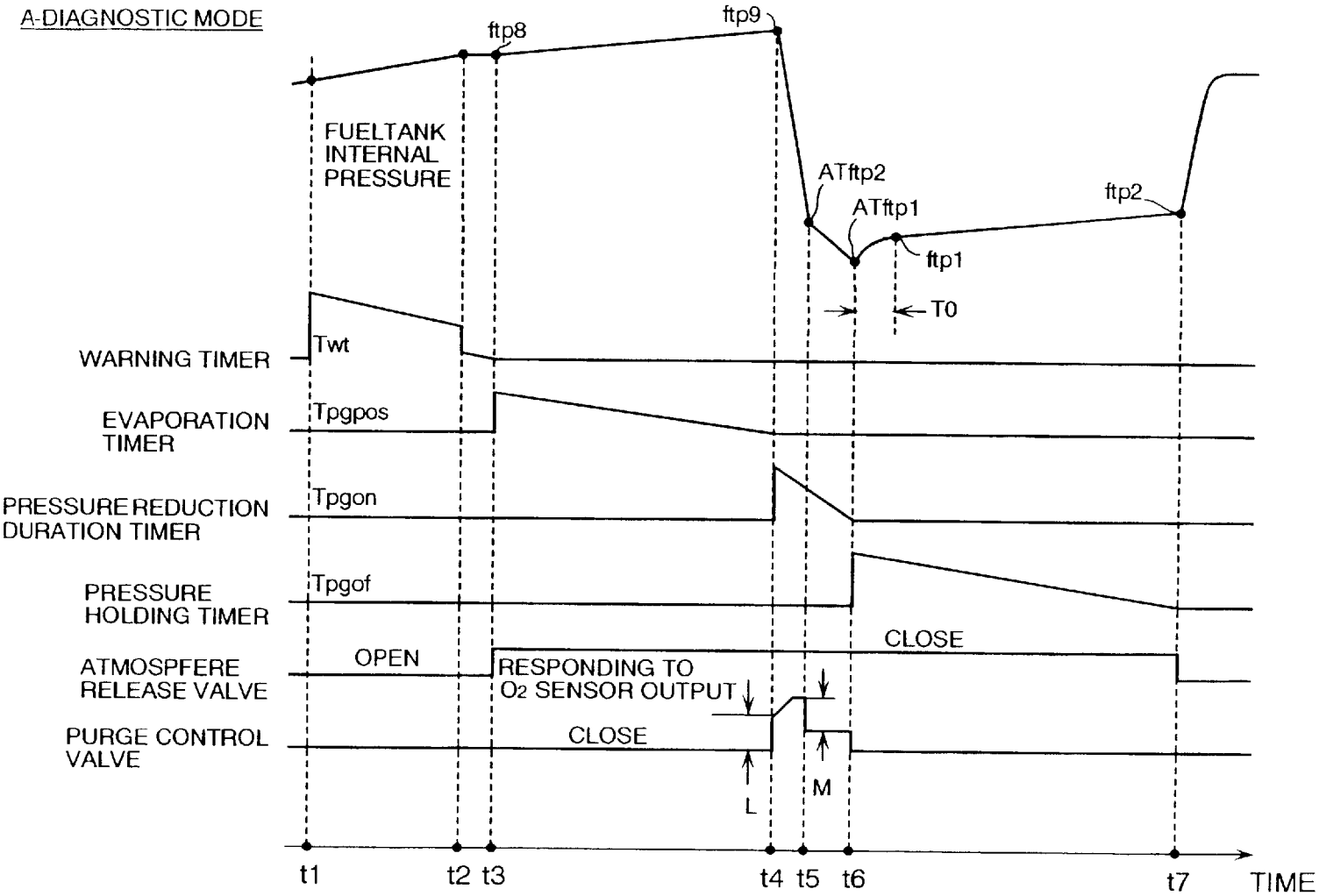
FIG. 3 is a time chart of a failure diagnosis in A-diagnostic mode.

FIG. 3 is a time chart illustrating the evaporation control system failure diagnosis in the A-diagnostic mode. After closing the purge control valve 35, a time until there occurs a rise in fuel tank internal pressure ftp approximately to the atmospheric pressure is counted by a waiting time. When the fuel tank internal pressure ftp reaches approximately the atmospheric pressure at a point of time t3, the atmosphere release valve 37 is closed and the evaporation timer is set to a preset time Tpgpos and concurrently started to count down the preset time Tpgpos. A fuel tank internal pressure ftp8 is detected by the pressure sensor S1 concurrently with closing the atmosphere release valve 37 and stored in a memory of the controller unit 100. When the evaporation timer counts down to zero (0) at a point of time t4, i.e. as soon as the preset time Tpgpos lapses, a fuel tank internal pressure ftp9 is detected and stored. Concurrently, the purge control valve 35 is opened by a specified valve opening tvo0 as an initial value to start depressurization in the evaporation control system. In this instance, the purge control valve 35 is changed in valve opening by an increment of a specified value every time the output from the oxygen ($O_2$) sensor is reversed, which is repeated until the purge control valve 35 opens up to a limit of valve opening. When the fuel tank internal pressure ftp falls down to a second target level of negative pressure (a second specified level of negative pressure) ATftp2 at a point of time t5, the purge control valve 35 is changed in valve opening by a decrement of a specified value and thereafter kept from changing so as to reduce a depressurizing rate of the fuel tank internal pressure. As time goes on, when the fuel tank internal pressure ftp reaches a first or final target level of negative pressure (a first specified level of negative pressure) ATftp1 at a point of time t6, the purge control valve 35 is fully closed so as to close up the evaporation control system hermetically and a negative pressure holding timer is set to a preset time. After a lapse of a specified short time from setting the negative pressure holding timer, the fuel tank internal pressure ftp1 is detected and stored. When the negative pressure holding timer counts down to zero (0) at a point of time t7, while the fuel tank internal pressure ftp2 is detected and stored, the atmosphere release valve 37 is opened immediately.

A reference value ARVftp as a diagnostic criteria for evaporation control system failure diagnosis in the A-diagnostic mode is given by the following expression (I);

$$ARVftp=(ftp2-ftp1)-K(ftp9-ftp8) \quad (I)$$

where K is a control constant

The term (ftp2−ftp1) represents a rise or difference in fuel tank internal pressure ftp while the fuel system remains closed up hermetically, i.e. a level of leakage of fuel vapors, and the term K(ftp9−ftp8) represents a natural rise in fuel tank internal pressure which is caused due to natural generation of fuel vapors. It is desirable for a diagnosis of a low level of leakage of fuel vapors to take an effect of a rise in fuel tank internal pressure due to natural generation of fuel vapors into consideration.

Therefore, as shown by the expression (I), the reference value ARVftp includes a reduction by the natural rise K(ftp9−ftp8). In order to judge leakage of fuel vapors, first and second threshold values ASS1 and ASS2 are prepared for normality judgement and abnormality judgement. In this instance, the first threshold value ASS1 for normality judgement is determined to be smaller than the second threshold value ASS2 for abnormality judgement. That is to say, it is judged that the evaporation control system is kept from leakage of fuel vapors and normal in operation when the reference value ARVftp is smaller than the first threshold value ASS1 for normality judgement or that the evaporation control system is leaking fuel vapors and abnormal in operation when the reference value ARVftp is larger than the second threshold value ASS2 for abnormality judgement.

Figure 4:
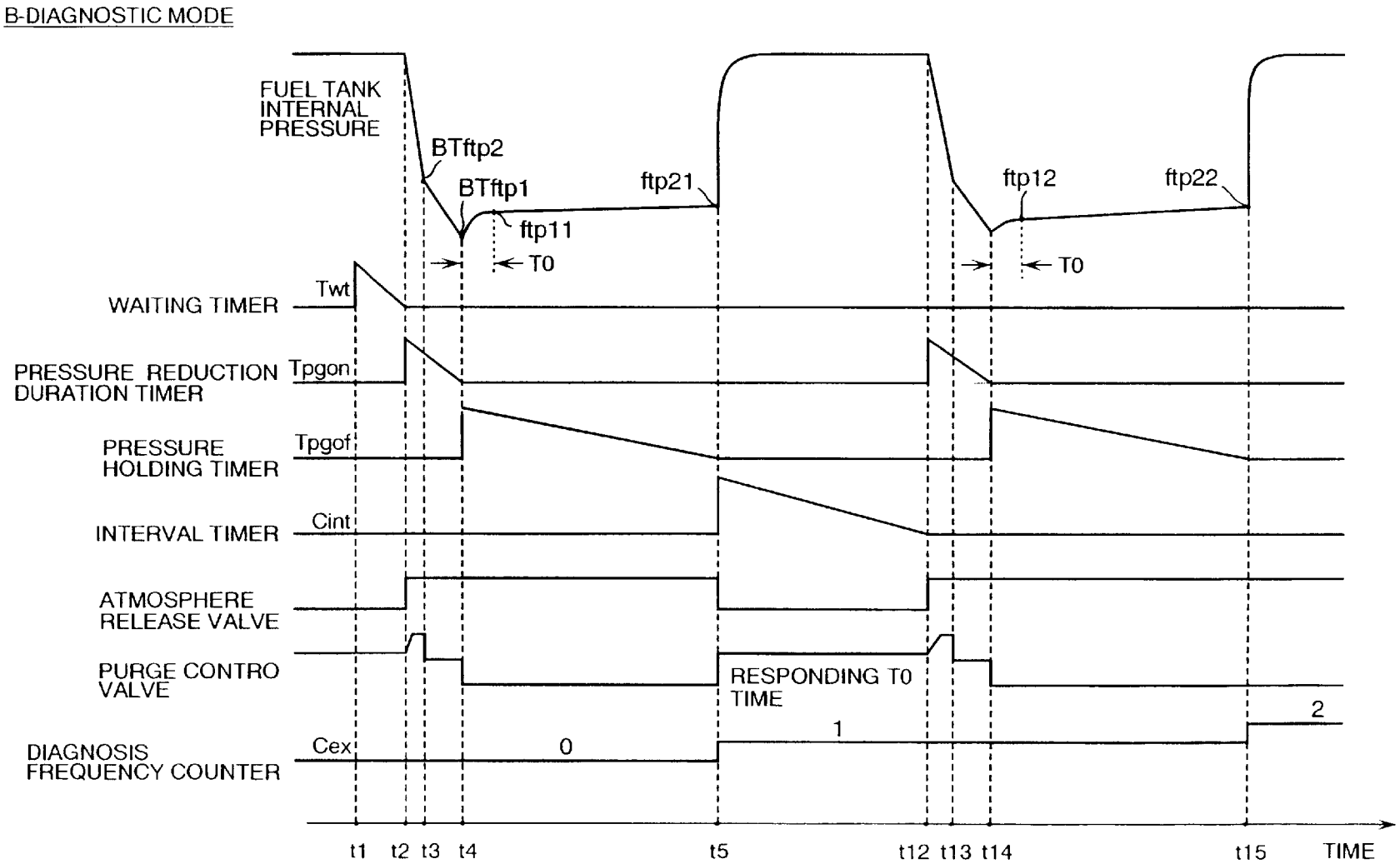
FIG. 4 is a time chart of a failure diagnosis in B-diagnostic mode.

FIG. 4 is a time chart illustrating the evaporation control system failure diagnosis in the B-diagnostic mode. In the B-diagnostic mode, detection of an early fuel tank internal pressure ftp11 (which corresponds to the fuel tank internal pressure ftp1 in the A-diagnostic mode) and a latter fuel tank internal pressure ftp21 (which corresponds to the fuel tank internal pressure ftp2 in the A-diagnostic mode) is repeated two times. In other words, the evaporation control system internal pressure reduction and atmosphere release valve close-up operation is implemented two times. Subsequently, an fuel tank internal pressure ftp12 is detected and stored at a point of time t14 at the early stage of closing-up the atmosphere release valve 37 succeeding to the second evaporation control system internal pressure reduction, and a fuel tank internal pressure ftp22 is detected and stored at a point of time t15 at the later stage of closing-up the atmosphere release valve 37. A time interval from a first occurrence of a rise in fuel tank internal pressure to a start of second evaporation control system internal pressure reduction is given by a period of time between point of times t5 and t12 as shown in FIG. 4.

A reference value BRVftp as a diagnostic criteria for evaporation control system failure diagnosis in the B-diagnostic mode is given by the following expression (II);

$$BRVftp=\{(ftp21-ftp11)+(ftp22-ftp12\}/2 \quad (II)$$

In short, the expression (II) corresponds to an arithmetic mean of two rises or differences in the fuel tank internal pressure (ftp2−ftp1). The utilization of two or more internal pressure differences in the fuel tank 21 is made in order to eliminate inaccuracy of the evaporation control system failure diagnosis due to noises. However, since a failure in the B-diagnostic mode diagnosis is implemented during traveling, there occurs condensation of fuel vapors in the fuel tank 21 due to wind, it is rather possible to make a wrong diagnosis when using the amount of fuel vapors generated before implementation of the depressurization of the fuel tank 21. For this reason, differently from the A-diagnostic mode, the amount of fuel vapors (a change in fuel tank internal pressure) generated before implementation of the depressurization of the evaporation control system is excluded in the B-diagnostic mode. It is of course that threshold values BSS1 and BSS2 are prepared for normality judgement and abnormality judgement, respectively, which are used in the B-diagnostic mode only and the threshold value BSS1 for normality judgement is determined to be smaller than the threshold value BSS2 for abnormality judgement. The evaporation control system is judged as normal in operation when the reference value BRVftp is smaller than the threshold value BSS1 for normality judgement or as abnormal in operation when the reference value RVBftp is larger than the threshold value BSS2 for abnormality judgement.

The evaporation control system failure diagnosis in the C-diagnostic mode is implemented in a similar manner to that in the B-diagnostic mode. However, in the C-diagnostic mode, a change in internal pressure in the evaporation control system caused by closing up the evaporation control system hermetically is taken into consideration only once like in the A-diagnostic mode. In light of detecting large leakage of fuel vapors in the C-diagnostic mode, a diagnosis of leakage of fuel vapors is made also pressure conditions during the depressurization.

Figure 5:
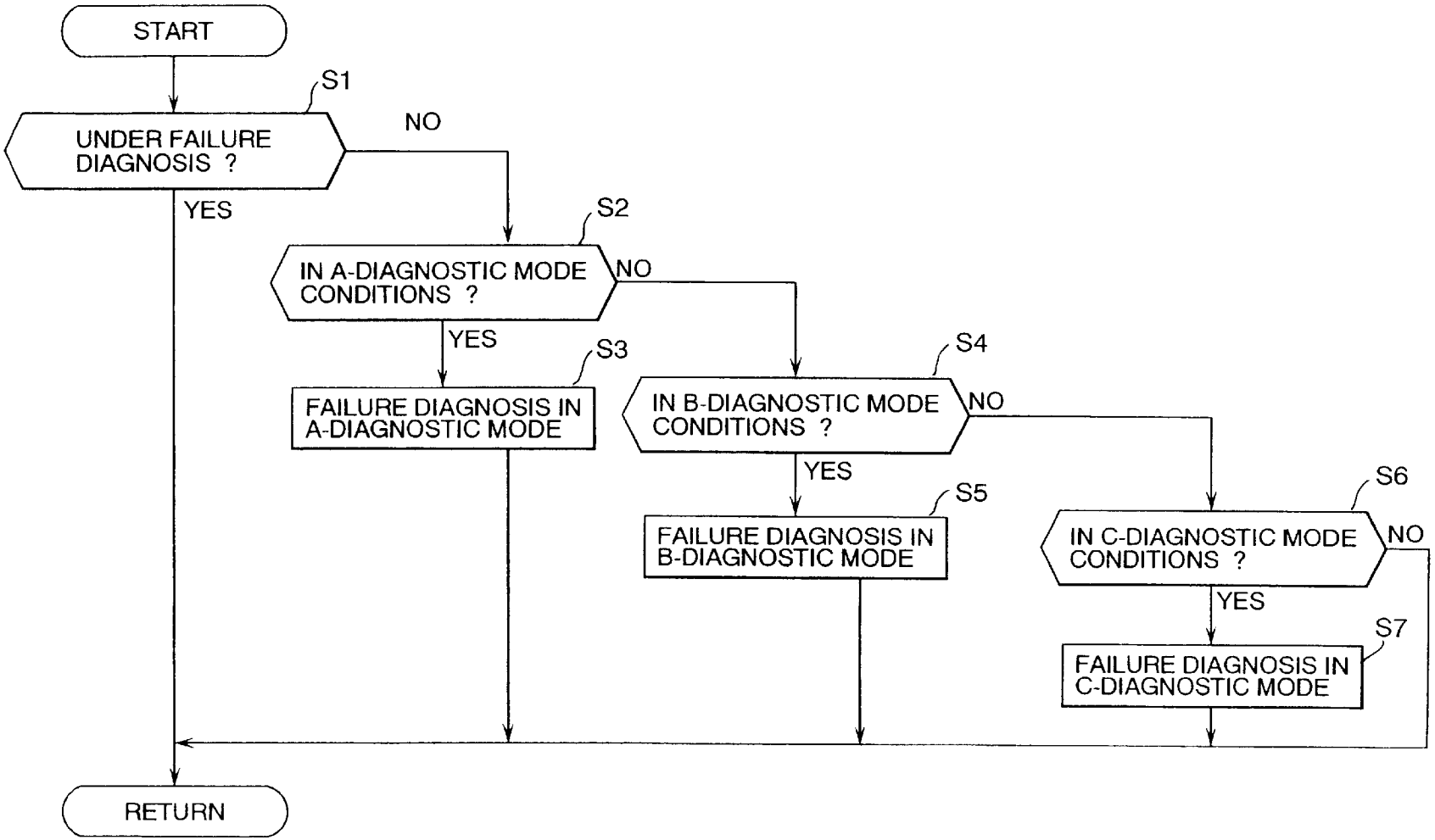
FIG. 5 is a flow chart illustrating a general routine of the failure diagnosis.

FIG. 5 is a flow chart illustrating a general sequence routine of the evaporation control system failure diagnosis. In the sequence routine, the timers and counters, although which are indicated as a down-counting type, are explained as a type counting up from an initial value of zero (0). As shown in FIG. 5, when the sequence logic commences and control proceeds to a judgement at step S1 as to whether the evaporation control system failure diagnosis is under implementation in any one of the A-, B- and C-diagnostic modes. When the answer is affirmative, then a decision is subsequently made at step S2 as to whether the conditions required for implementation of the evaporation control system failure diagnosis in the A-diagnostic modes (which are referred to as A-diagnostic mode conditions) are satisfied. When all of the A-diagnostic mode conditions are satisfied, then the evaporation control system failure diagnosis is implemented in the A-diagnostic mode at step S3. On the other hand, if at least one of the A-diagnostic mode conditions is unsatisfied, then a decision is made at step S4 as to whether the conditions required for implementation of the evaporation control system failure diagnosis in the B-diagnostic mode (which are referred to as B-diagnostic mode conditions) are satisfied. When all of the B-diagnostic mode conditions are satisfied, then the evaporation control system failure diagnosis is implemented in the B-diagnostic mode at step S5. On the other hand, if at least one of the B-diagnostic mode conditions is unsatisfied, then a decision is made at step S6 as to whether the conditions required for implementation of the evaporation control system failure diagnosis in the C-diagnostic mode (which are referred to as C-diagnostic mode conditions) are satisfied. When all of the C-diagnostic mode conditions modes are satisfied, then the evaporation control system failure diagnosis is implemented in the C-diagnostic mode at step S7. When the answer to the decision concerning implementation of the evaporation control system failure diagnosis made at step S1 is negative, or when the conditions required for the A-, B- and C-diagnostic modes are unsatisfied, or after implementation of the evaporation control system failure diagnosis in either one of the A-, B- and C-diagnostic modes, the sequence logic order s return for another implementation of the evaporation control system failure diagnosis.

FIGS. 6A to 6F are a flow chart illustrating a subroutine of the evaporation control system failure diagnosis in the A-diagnostic mode. When the A-diagnostic mode conditions are all satisfied, the sequence logic commences and control proceeds to a function block at step S101 where an operation time counter is reset to an initial value of zero (Tst=0). Subsequently after detecting current driving conditions at step S102, a decision is made at step S103 as to whether the engine has started operation. After waiting until the engine has started operation, a retrial counter is reset to an initial value of zero (Crt=0). The retrial counter counts a number of times of retrial Crt of the evaporation control system failure diagnosis in the A-diagnostic mode. Thereafter, after resetting a low vehicle speed detection counter to an initial value of zero (CVsp=0) at step S105, a current vehicle speed Vsp is detected at step S106. A decision is subsequently made at step S107 as to whether the vehicle speed Vsp is lower than a specified speed Vsp0. The detection as to a current vehicle speed Vsp with respect to the specified speed Vsp0 is repeated until a current vehicle speed Vsp becomes below the specified speed Vsp0. When the current vehicle speed Vsp is still lower than the specified speed Vsp0 once, then, after changing the detection count CVsp by an increment of one at step S108, a decision is made at step S109 as to whether a specified value CVsp0 is exceeded by the low vehicle speed detection count CVsp. The specified value CVsp0 indicates a duration of travel of the vehicle at speeds lower than the specified speed Vsp0 for a specified period of time. This decision as to the duration of travel of the vehicle at speeds lower than the specified speed Vsp0 is repeated until the specified value CVsp0 is exceeded.

Figure 6A:
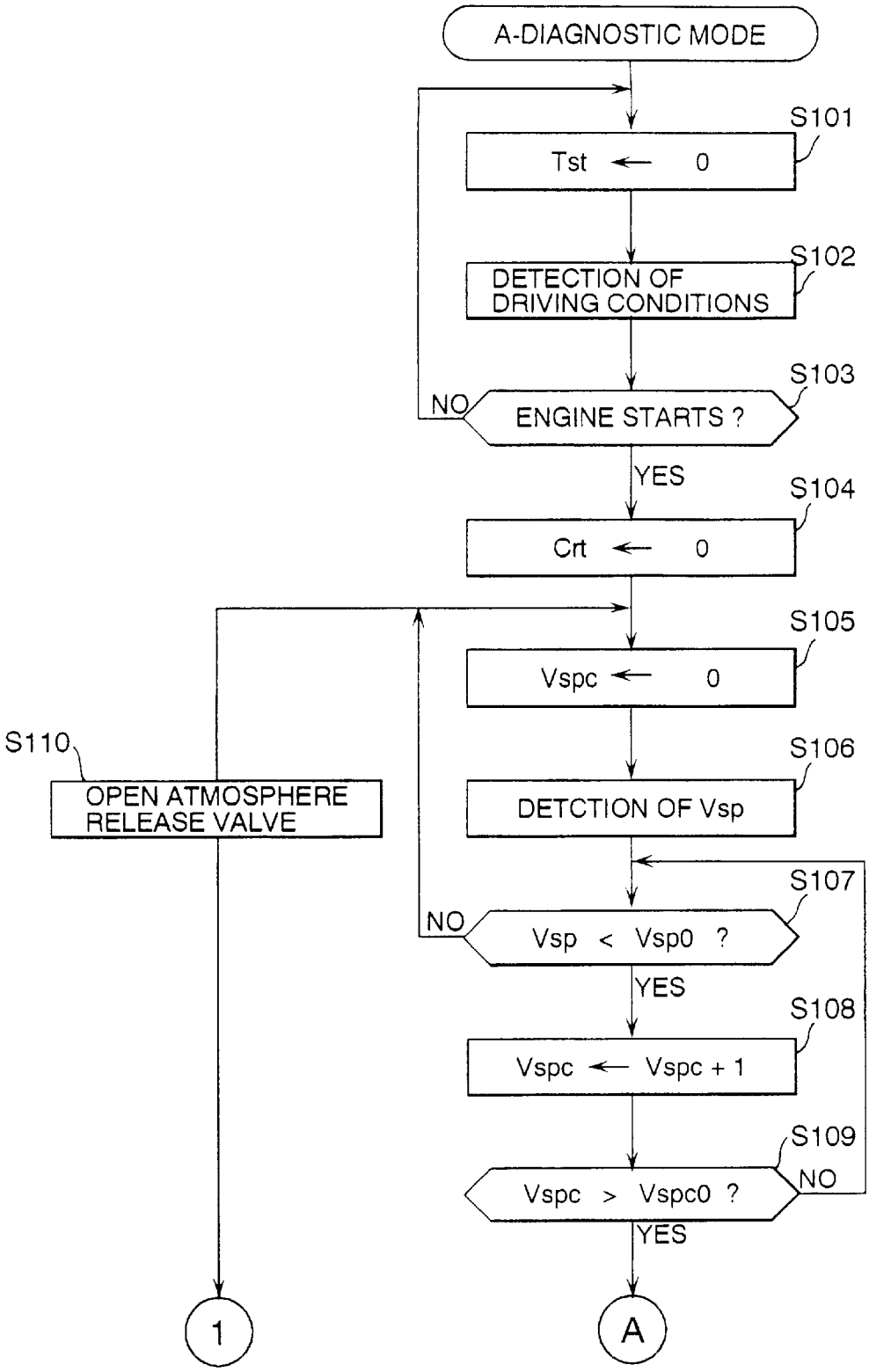
FIGS. 6A to 6F are a flow chart illustrating a subroutine of the failure diagnosis in A-diagnostic mode.
Figure 6B:
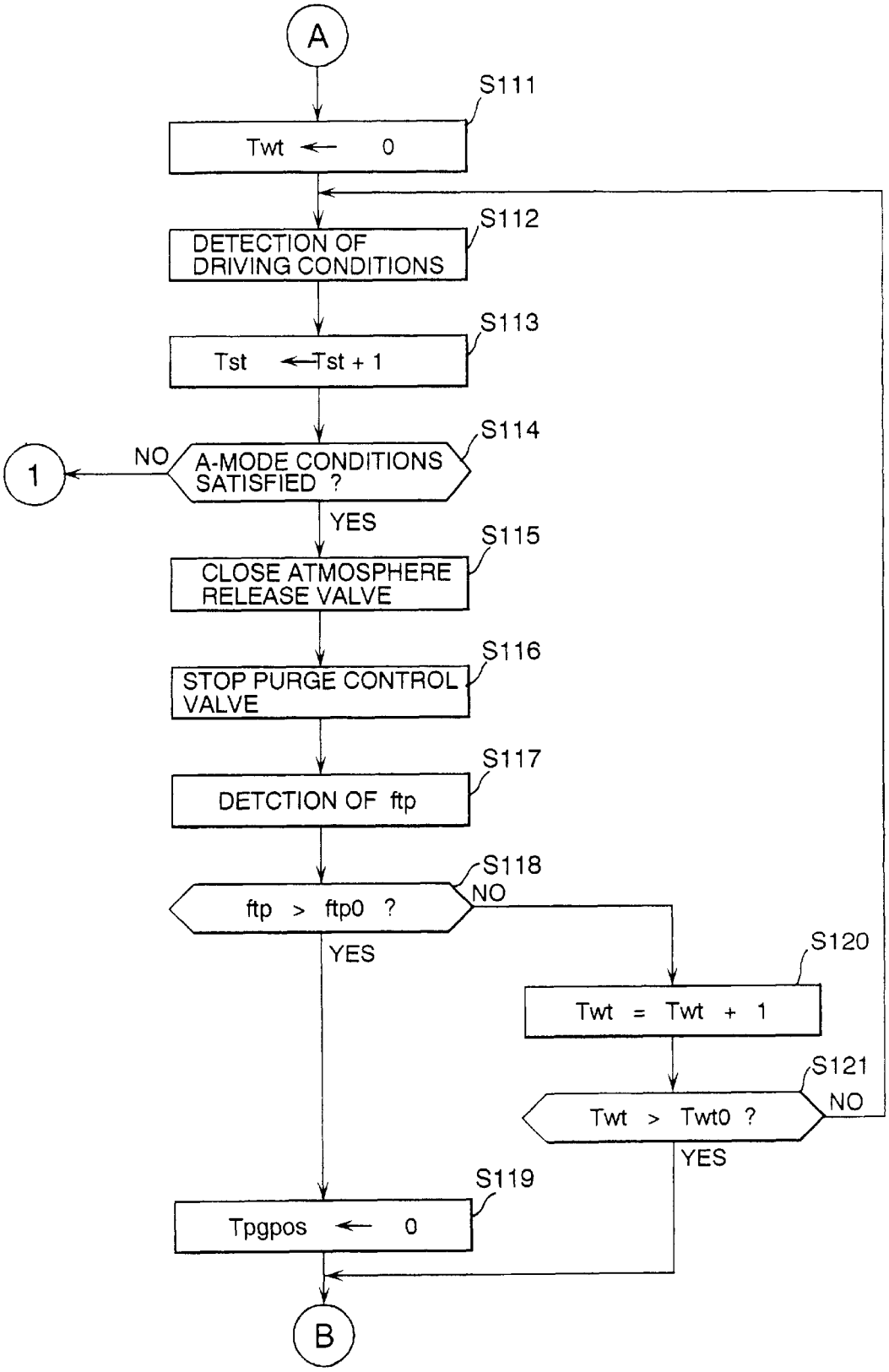
Figure 6C:
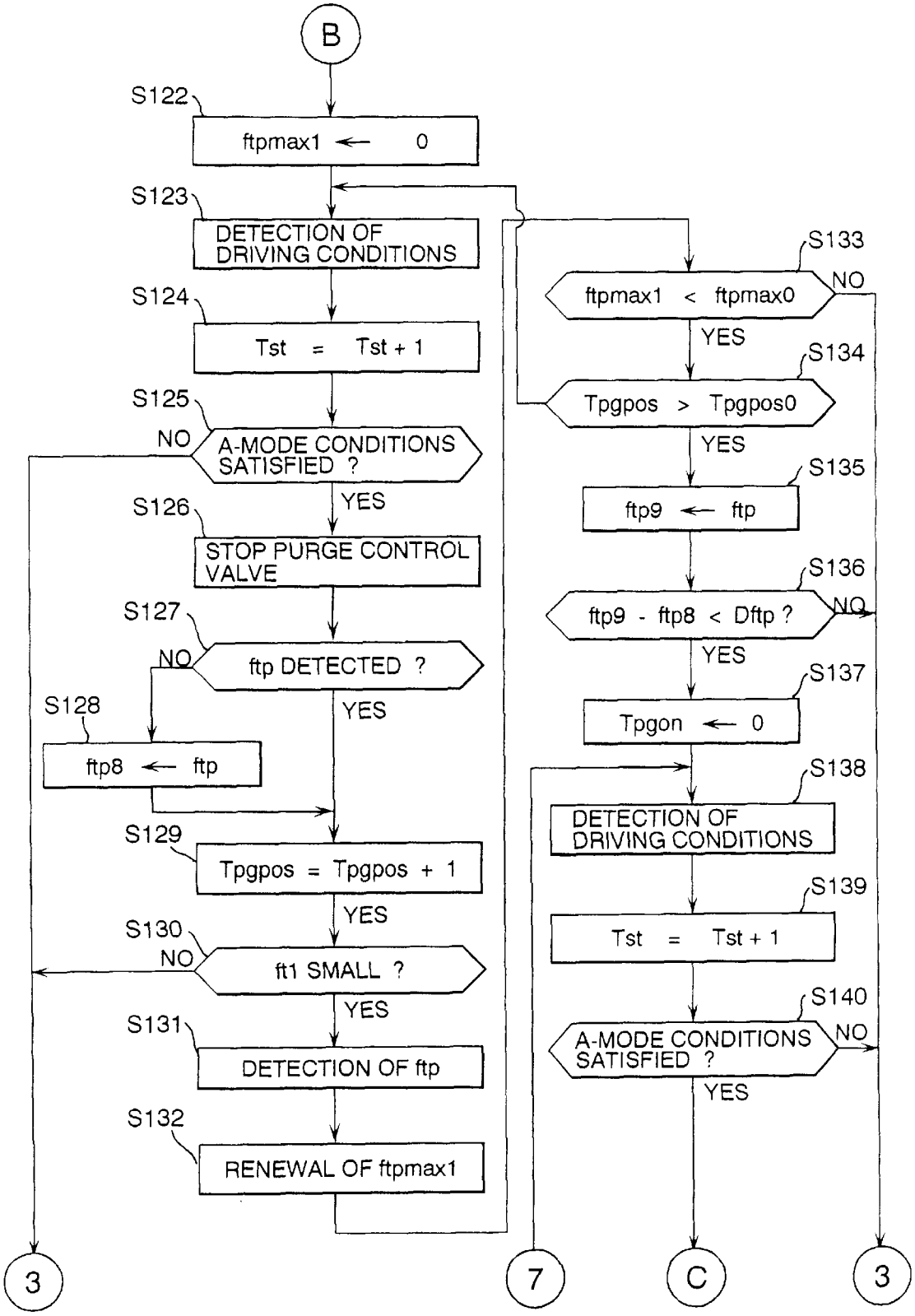
Figure 6D:
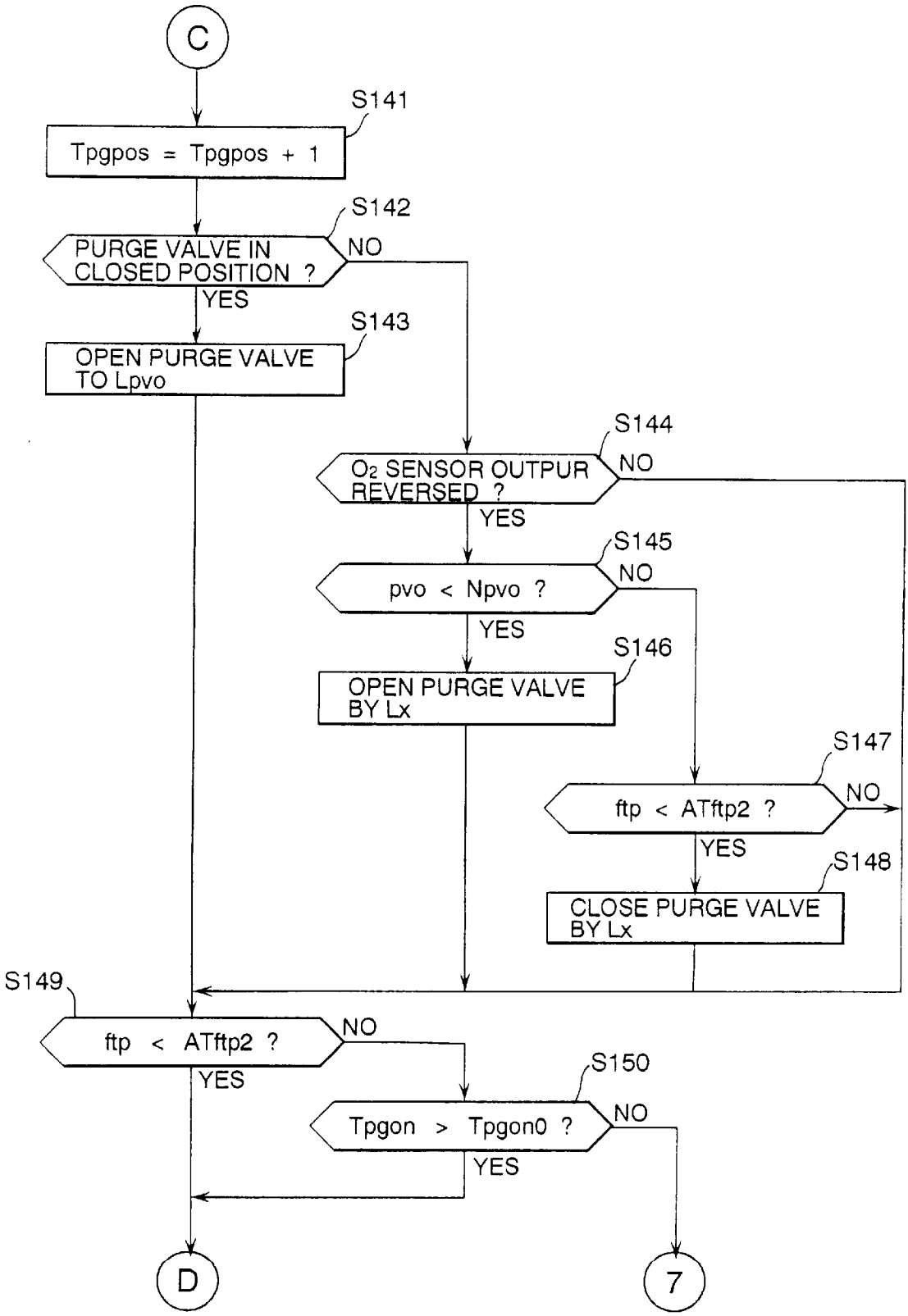
Figure 6E:
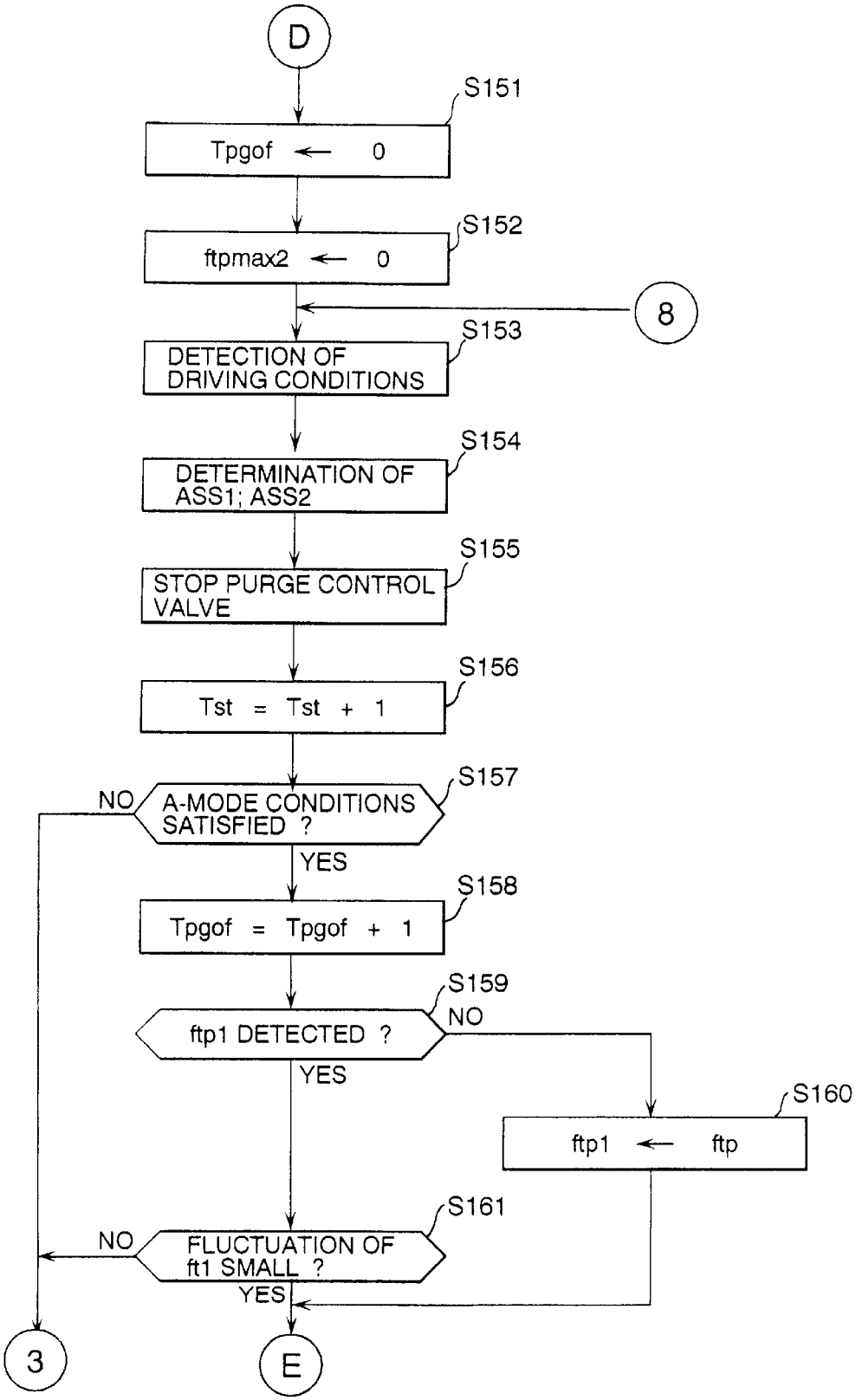
Figure 6F:
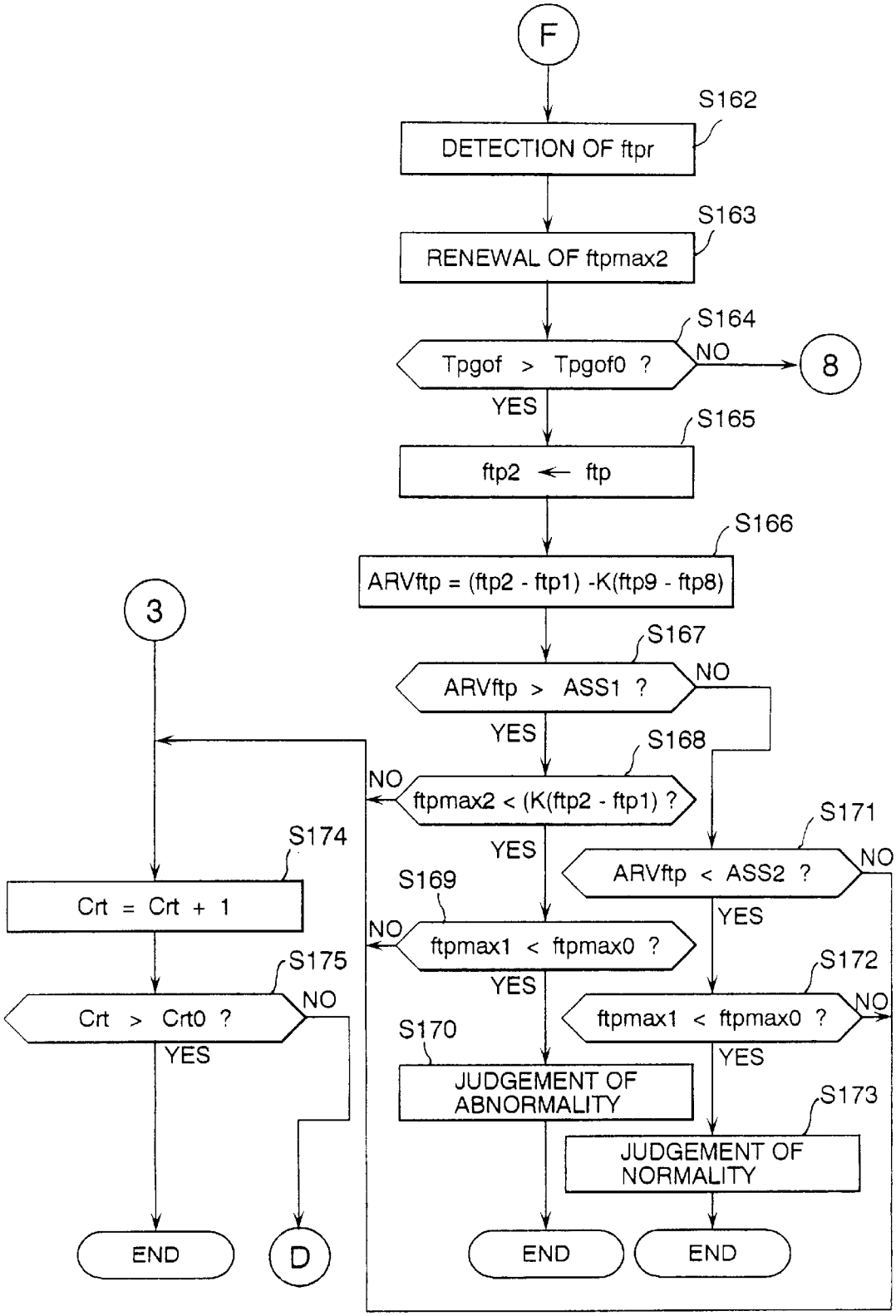
Figure 7A:
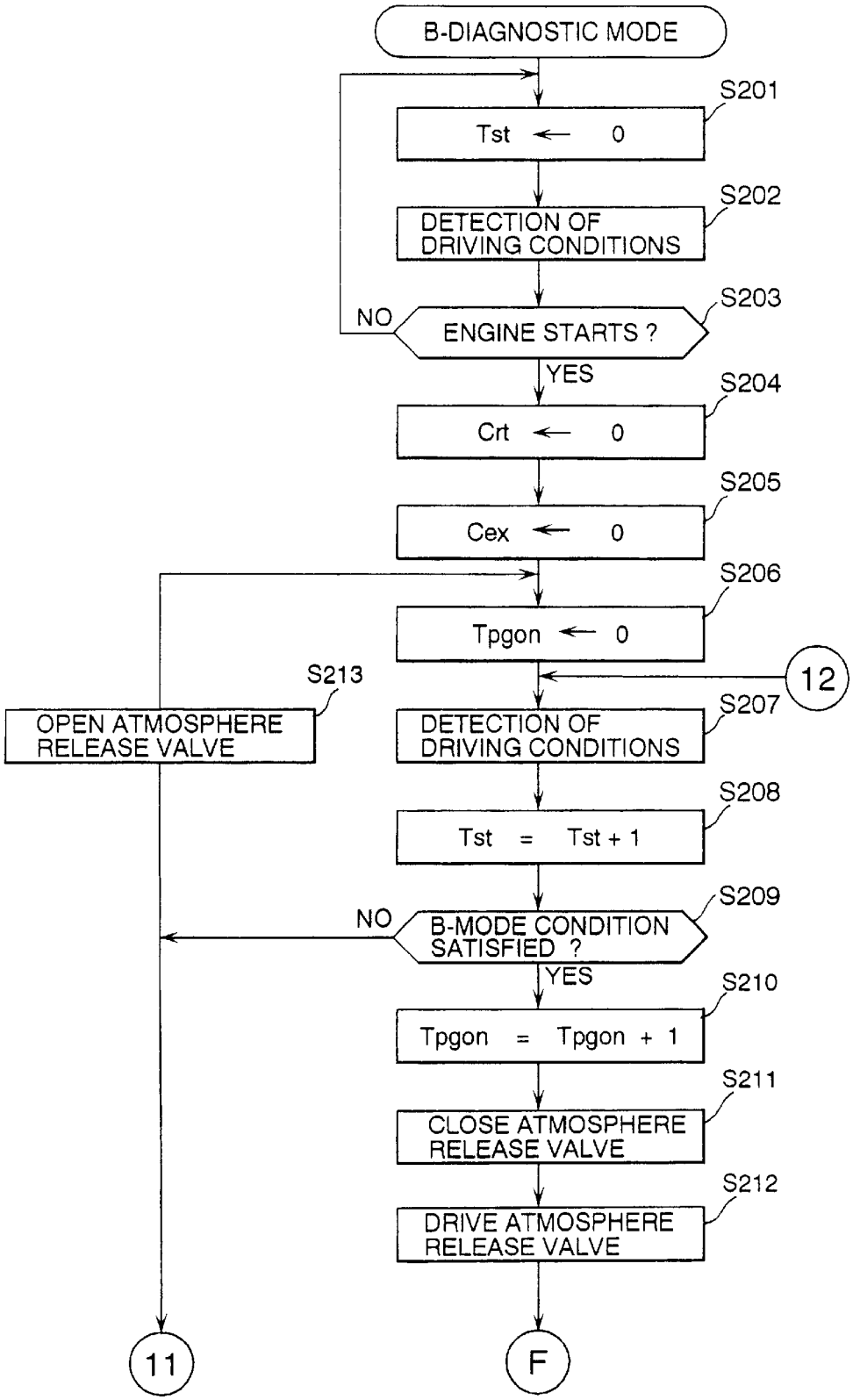
FIGS. 7A to 7E are a flow chart illustrating a subroutine of the failure diagnosis in B-diagnostic mode.
Figure 7B:
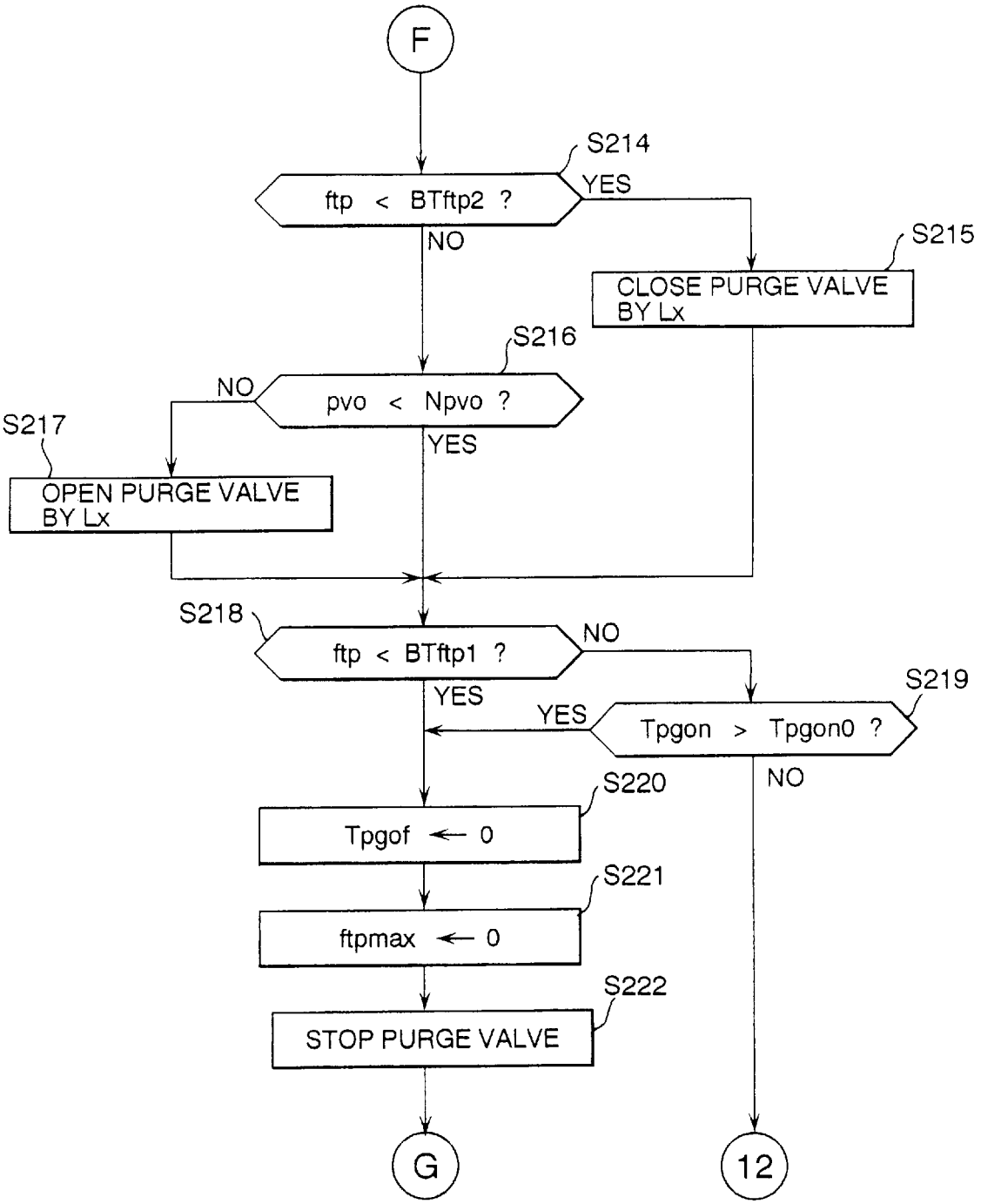
Figure 7C:
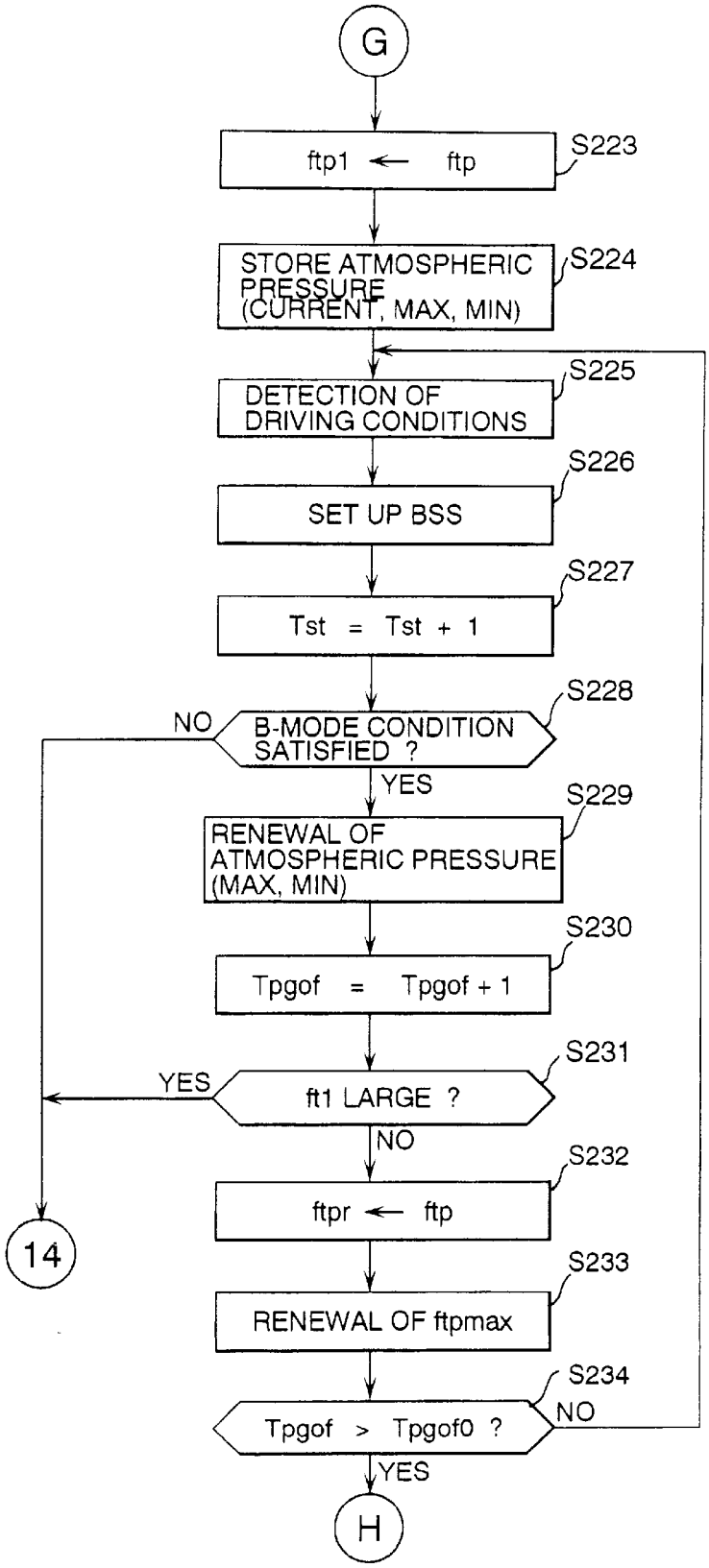
Figure 7D:
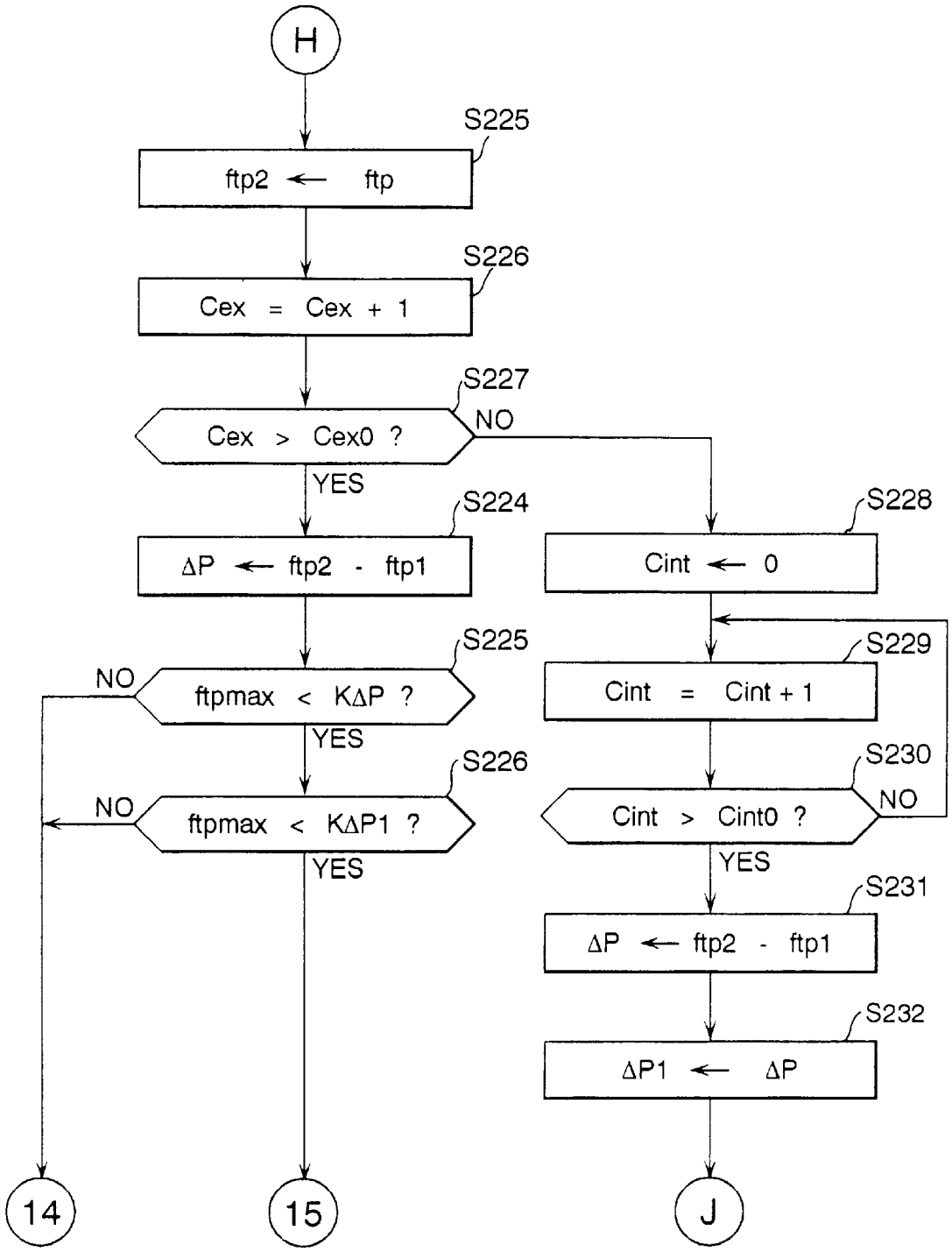
Figure 7E:
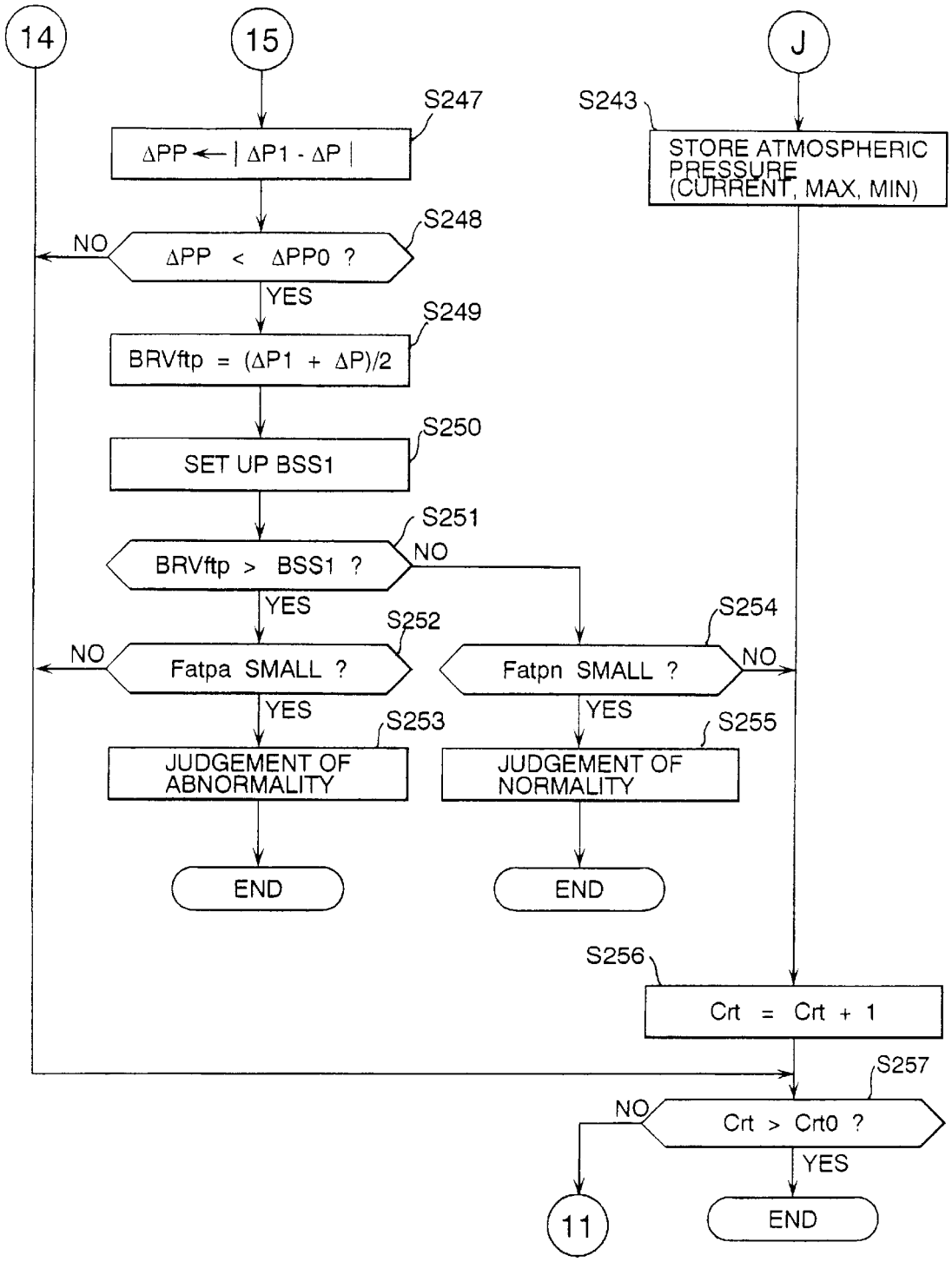
Figure 8A:
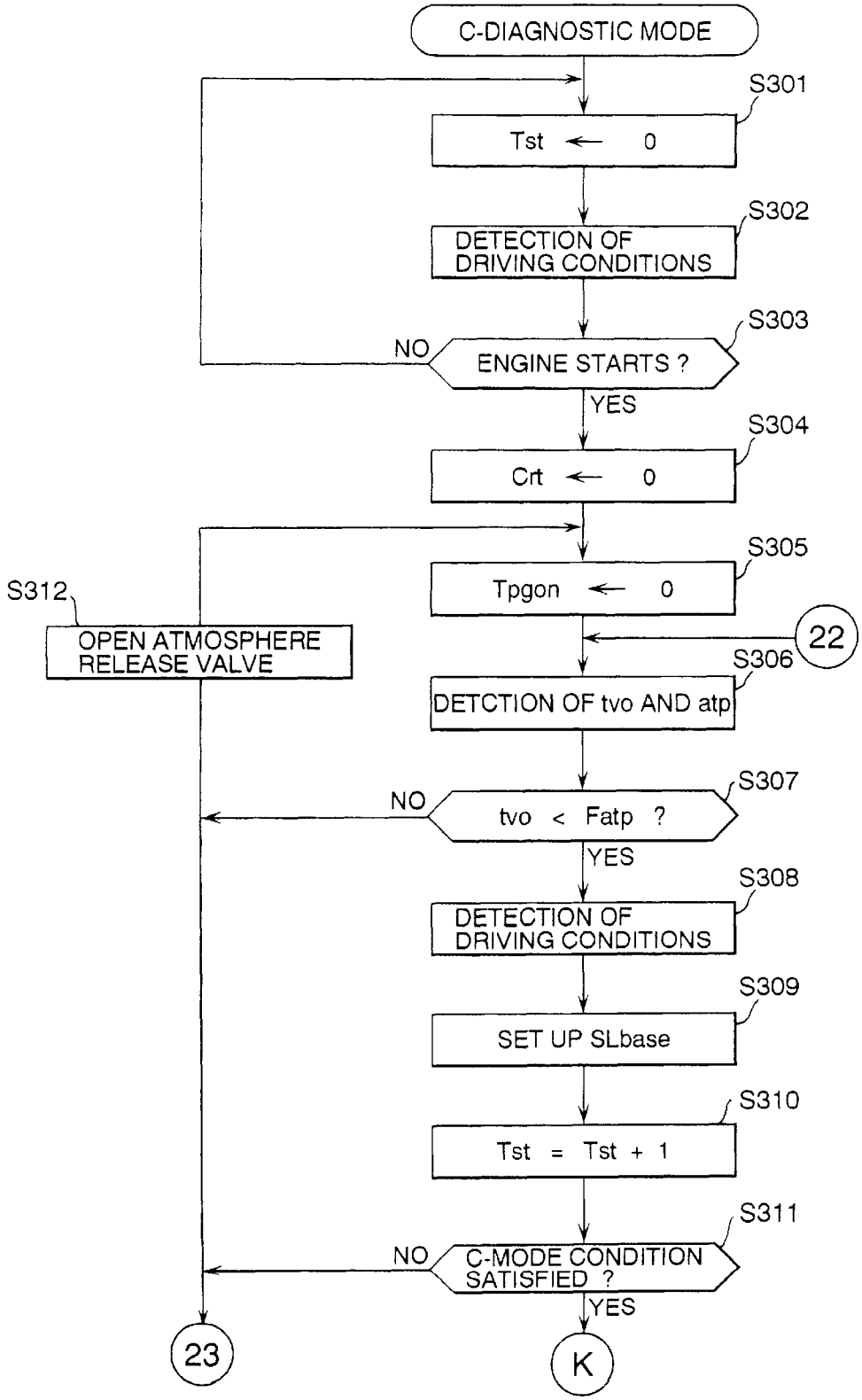
FIGS. 8A to 8F are a flow chart illustrating a subroutine of the failure diagnosis in C-diagnostic mode.
Figure 8B:
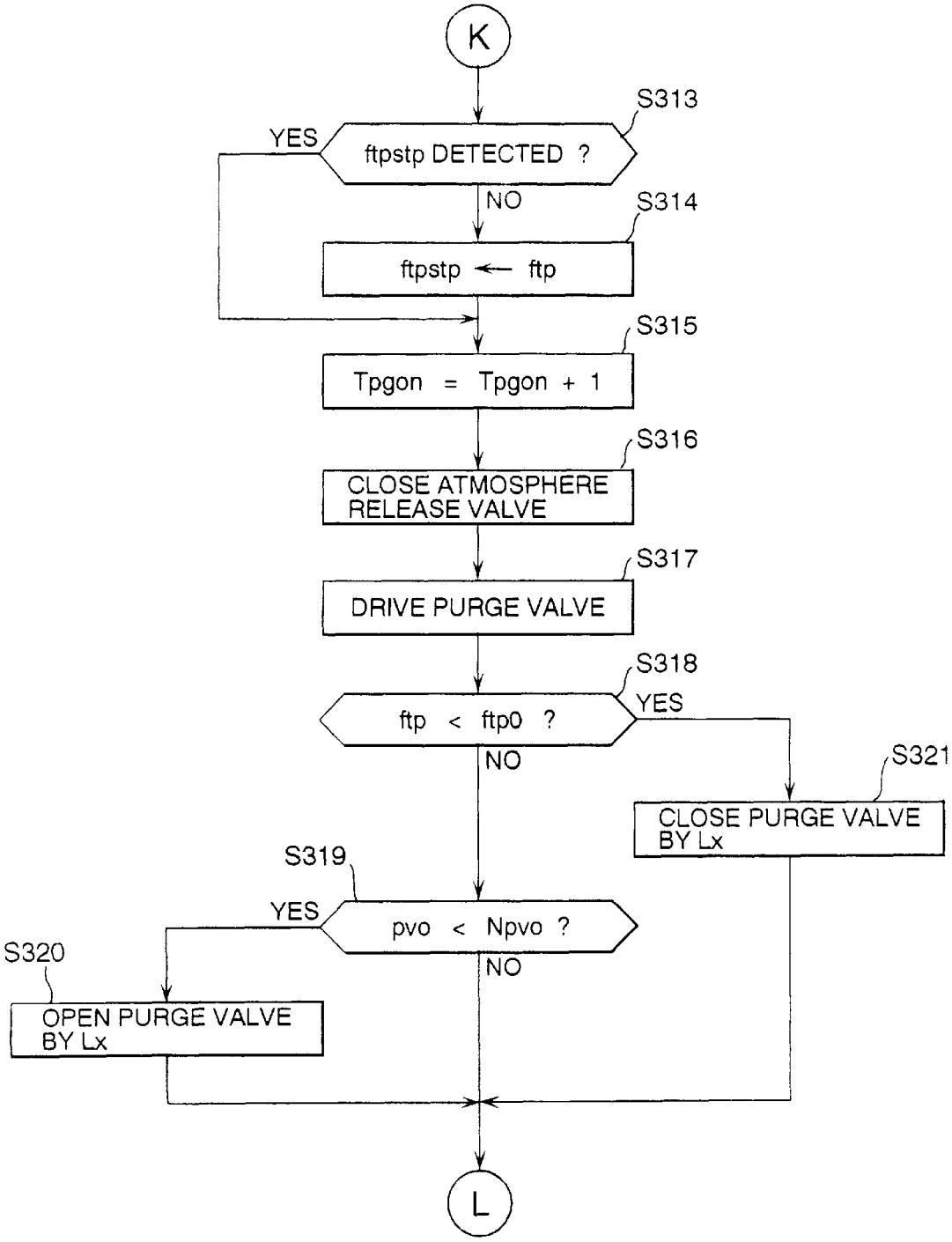
Figure 8C:
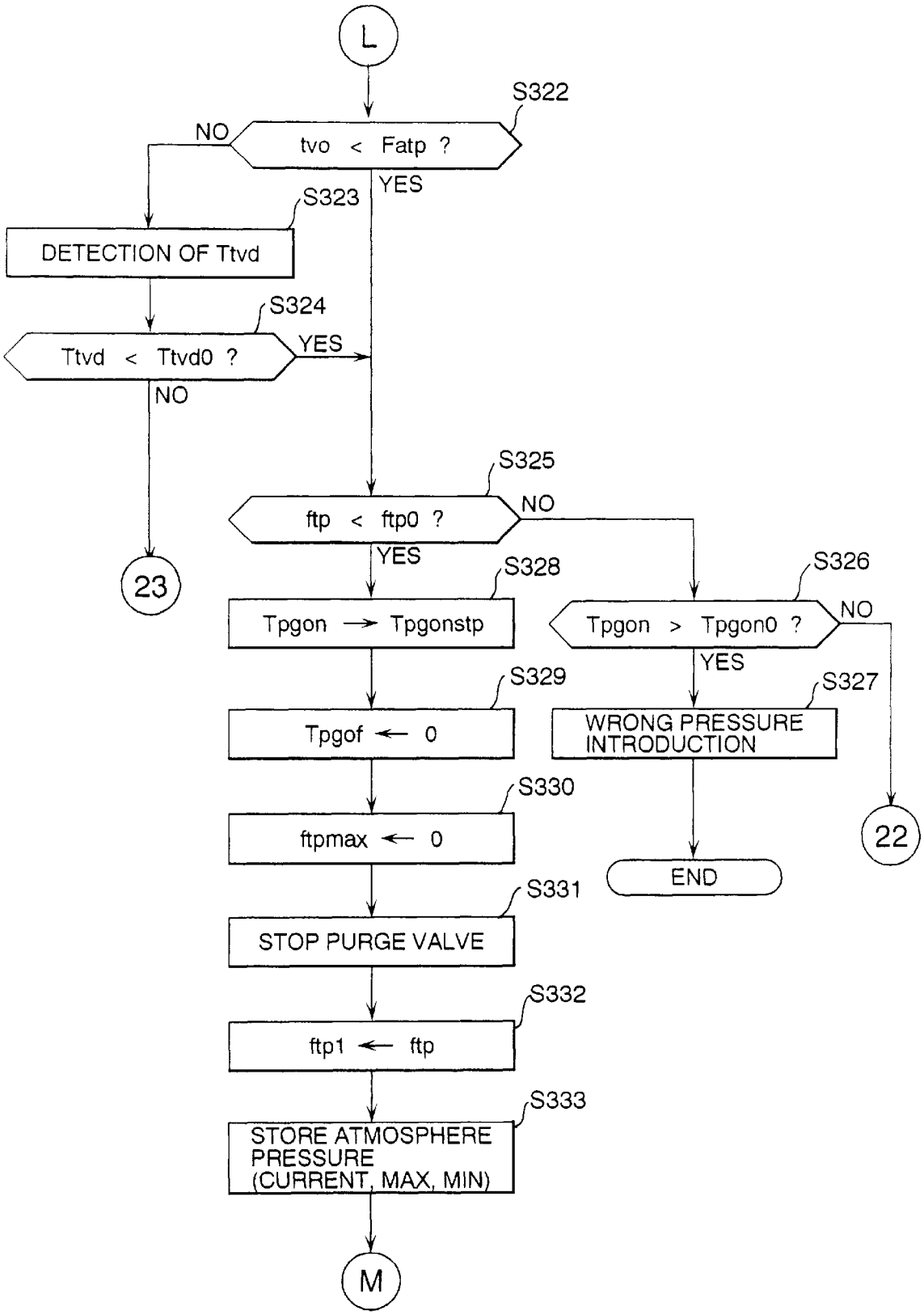
Figure 8D:
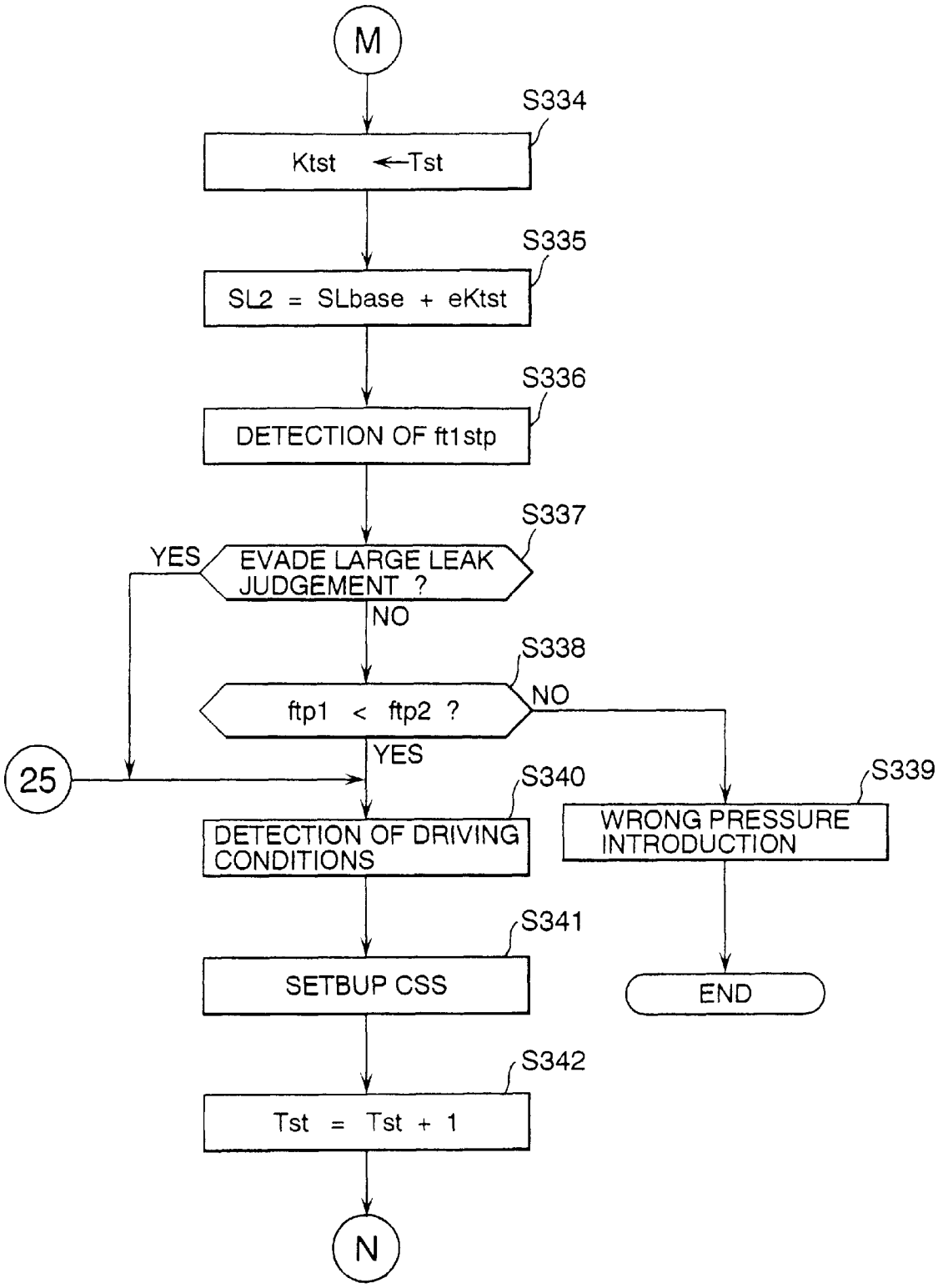
Figure 8E:
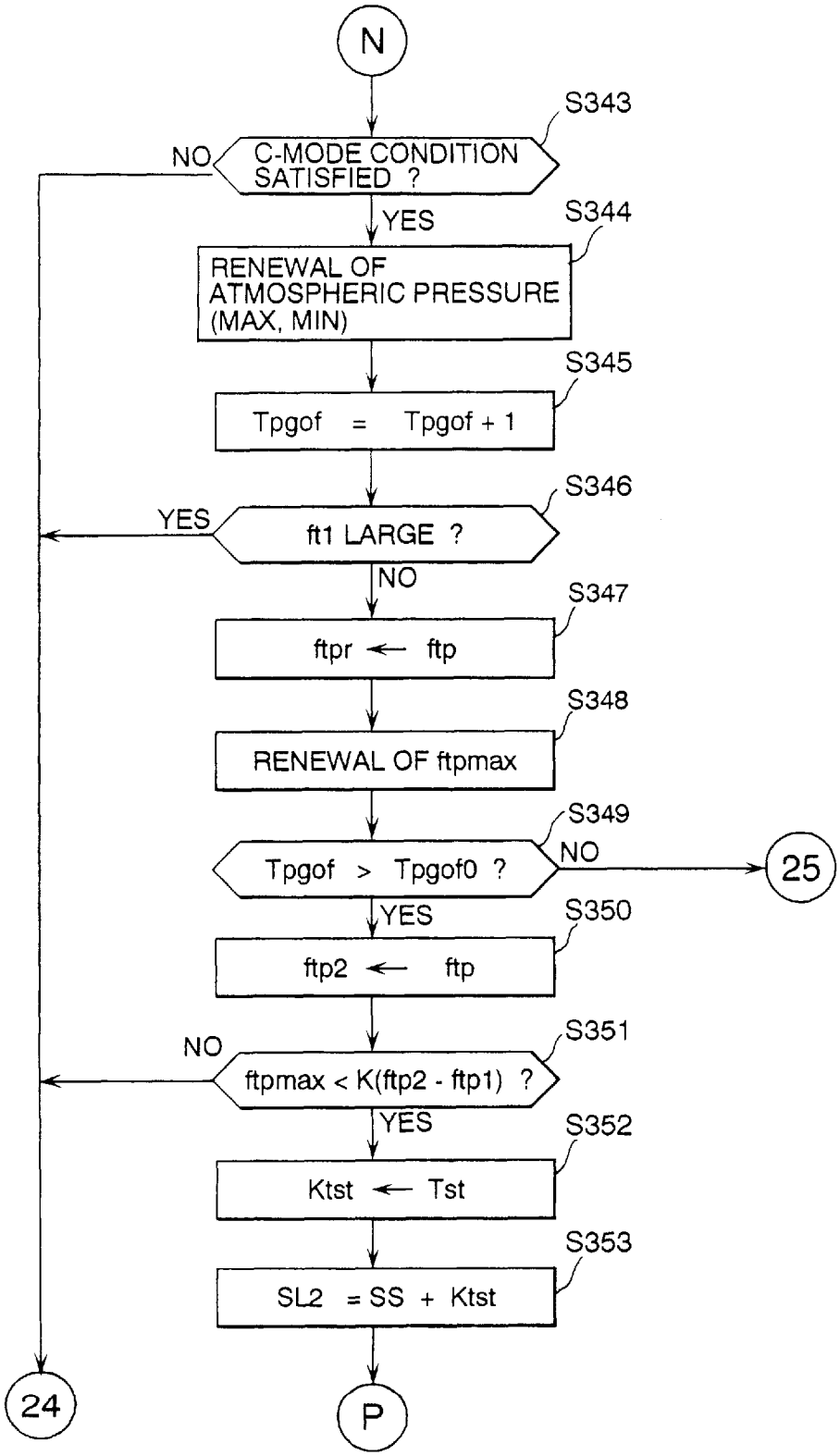
Figure 8F:
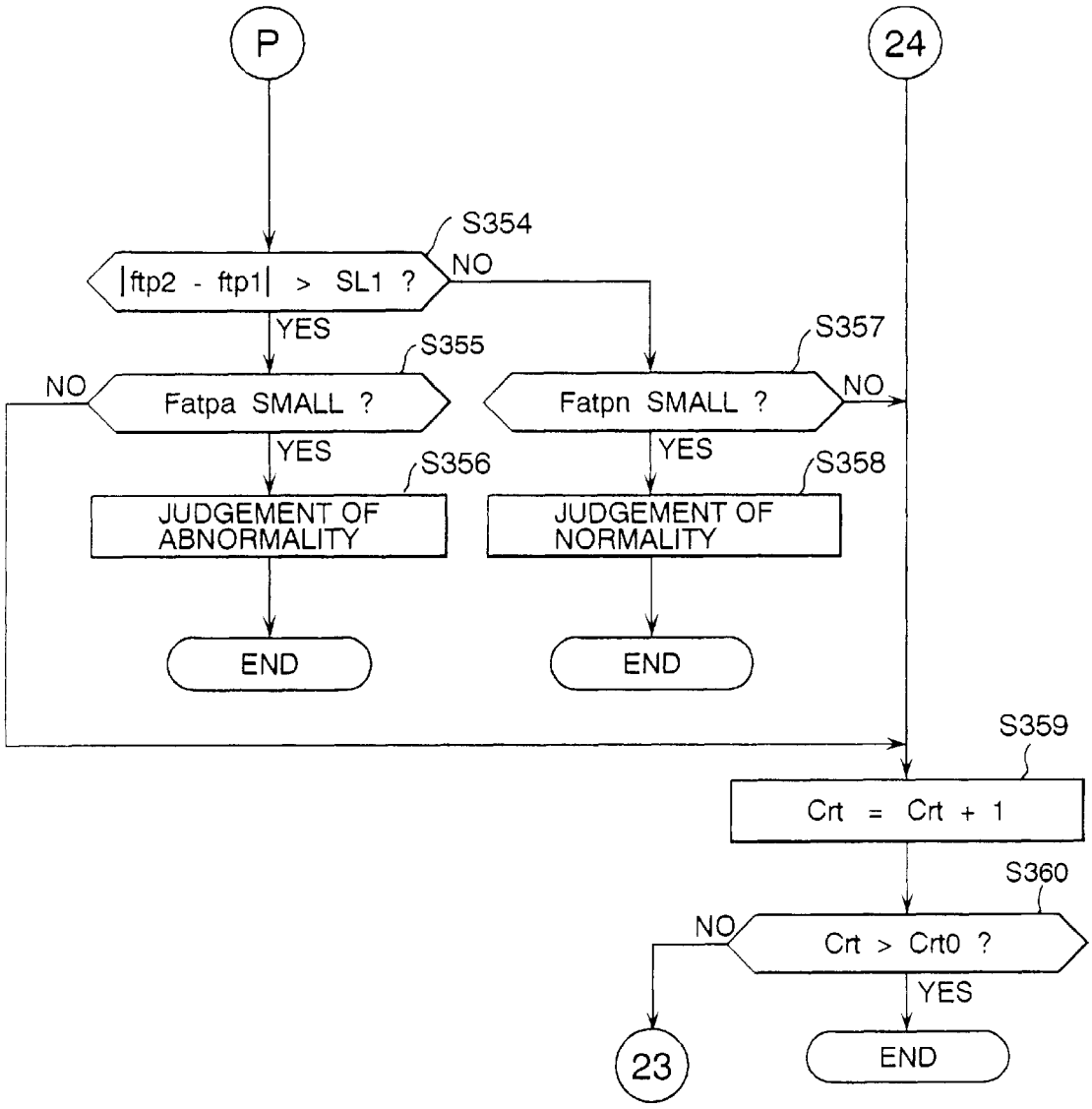

When the specified value CVsp0 is exceeded, the control proceeds to a function block at step S111 in FIG. 6B where a diagnosis waiting timer is reset to an initial value of zero (Twt=0). Subsequently, after detecting current driving conditions at step S112 and causing an operation time counter to change a number of engine starts Tst by an increment of one at step S113, a decision is made at step S114 as to whether the A-diagnostic mode conditions are all satisfied. When the answer to the decision is negative, this indicates that one or more A-diagnostic mode conditions are unsatisfied, then after opening the atmosphere release valve 37 at step S110 in FIG. 6A, the sequence logic orders return to step S105 through S113 for making another decision as to the A-diagnostic mode conditions. On the other hand, the answer to the decision is affirmative, this indicates that the A-diagnostic mode conditions are all satisfied, then after closing up the atmosphere release valve 37 at step S115 and interrupting the purge control valve 35 so as to cause the fuel tank internal pressure ftp return to positive pressure at step S116, the fuel tank internal pressure ftp is detected at step S117. Subsequently a decision is made at step S118 as to the fuel tank internal pressure ftp is higher than a specified level of pressure ftp0. When the fuel tank internal pressure ftp is lower than the specified level of pressure ftp0, after causing the waiting timer to change its count Twt by an increment of one at step S120, a decision is made at step S121 as to whether the waiting timer has counted up a specified value Twt0. When the waiting count Twt is less than the specified value Twt0, the sequence logic orders return to step S112 to detect current driving conditions. On the other hand, when the fuel tank internal pressure ftp is higher than the specified level of pressure ftp0 or when the waiting count Twt is greater than the specified value Twt0, the evaporation timer is reset to an initial time of zero (Tptgos=0) at step S119 and a maximum fuel tank internal pressure ftprmax1 for jolt judgement is subsequently reset to an initial level of zero (0) at step S122.

Thereafter, after detecting current driving conditions at step S123 and causing the operation time counter to change the count Tst by an increment of one at step S124, a decision is made at step S125 as to whether the A-diagnostic mode conditions are all satisfied. When one or more of the A-diagnostic mode conditions are unsatisfied, the sequence logic skips steps S126 through S173 and proceeds to step S174 without making both normality judgement and abnormality judgement. On the other hand, when the A-diagnostic mode conditions are all satisfied, after interrupting the purge control valve 35 at step S126, a decision is made at step S127 as to whether a fuel tank internal pressure ftp8 for reference value determination has been detected. Subsequently, the evaporation timer is caused to change the count Tpgpos by an increment of one at step S129 directly when the fuel tank internal pressure ftp8 for reference value determination has been detected or after treating a current fuel tank internal pressure ftp as a fuel tank internal pressure ftp8 for reference value determination and storing it in the memory of the control unit 100 at step S128 when the fuel tank internal pressure ftp8 has not yet been detected. At step S130, a decision is made as to whether a fluctuation of liquid level ft1 in the fuel tank 21 is small. When the fluctuation of liquid level ft1 is decided to be small, then a fuel tank internal pressure ftp is detected and stored as a fuel tank internal pressure ftpr for jolt judgement at step S131, and the maximum fuel tank internal pressure ftpmax1 is renewed at step S132. In this instance, either one of a deviation between the current and last fuel tank internal pressures ftpr and the last maximum fuel tank internal pressure ftpmax1 that is stored in the memory of the control unit 100 that is greater than the other is treated as a renewed maximum fuel tank internal pressure ftpmax1. Subsequently, a decision is made at step S133 as to whether the maximum fuel tank internal pressure ftpmax1 is lower than a specified maximum level of fuel tank internal pressure ftpmax0. When the maximum fuel tank internal pressure ftpmax1 exceeds the specified maximum level of fuel tank internal pressure ftpmax0, then the sequence logic skips steps S126 through S173 and proceeds to step S174 without making both normality judgement and abnormality judgement. On the other hand, when whether the maximum fuel tank internal pressure ftpmax1 is lower than the specified maximum level of fuel tank internal pressure ftpmax0, then a decision is succeedingly made at step S134 as to whether the count Tpgpos of the evaporation timer is greater than a specified value Tpgpos0. When the answer to the decision is affirmative, this indicates that the point of time t4 (see FIG. 3) is reached, then the current fuel tank internal pressure ftp is stored as a pressure ftp9 for reference value determination at step S135. On the other hand, when the count Tpgpos of the evaporation timer is still smaller than the specified value Tpgpos0, the sequence logic repeats steps S123 through S133 until exceeding the specified value Tpgpos0. Subsequently, a decision is further made at step S136 as to whether a deviation of the fuel tank internal pressure ftp9 from the fuel tank internal pressure ftp8 is smaller than a specified value Dftp. When the answer to the decision is affirmative, this indicates that the amount of fuel vapors that are naturally generated is small, then after resetting a pressure reduction duration timer to an initial value of zero (Tpgon=0) at step S137, current driving conditions are detected at step S138. On the other hand, when the answer to the decision made at step S136 is negative, this indicates that the amount of fuel vapors that are naturally generated in the fuel tank 21 is larger, then the sequence logic skips steps S137 through S173 and proceeds to step S174 without making both normality judgement and abnormality judgement. Further, after causing the operation time counter to change the count Tst by an increment of one at step S139, a decision is made at step S140 as to whether the A-diagnostic mode conditions are all satisfied. The sequence logic proceeds to step S141 in FIG. 6D when the A-diagnostic mode conditions are all satisfied or skips steps S141 through S173 and proceeds to step S174 without making both normality judgement and abnormality judgement when one or more of the A-diagnostic mode conditions are unsatisfied.

After changing the count of pressure reduction time or duration of time for negative pressure reduction duration time Tpgon by an increment of one at step S141, a decision is made at step S142 as to whether the purge control valve 35 is fully closed. The purge control valve 35 is caused to open to the initial valve opening Lpvo at step S143 as shown in FIG. 3 when it is in a closed position. On the other hand, when the purge control valve 35 is out of the closed position, this indicates that it is after the point of time t4, then a decision is made at step S144 as to whether an output from the oxygen ($O_2$) sensor 13R, 13L has reversed. When the answer to the decision is affirmative, a decision is subsequently made at step S145 as to whether the purge control valve 35 has opened to its upper limit valve opening Npvo. When the purge control valve 35 remains open smaller than the upper limit valve opening Npvo, the purge control valve 35 is caused to open more by a specified small valve opening Lx at step S146. On the other hand, when the purge control valve 35 has opened exceeding the upper limit valve opening Npvo, then, a decision is further made at step S147 as to whether the fuel tank internal pressure ftp is equal to or lower than the second target level of negative pressure ATftp2. When the fuel tank internal pressure ftp is equal to or lower than the second target level of negative pressure ATftp2, the purge control valve 35 is caused to close by a specified valve opening Lx and is held at the valve opening at step S148. After causing the purge control valve 35 to change its valve opening at step S143, S146 or S148 or when it is decided that the fuel tank internal pressure ftp is higher than the second target level of negative pressure ATftp2 at step S147, a decision is subsequently made at step S149 as to whether the fuel tank internal pressure ftp is equal to or lower than the first target level of negative pressure ATftp1. When the fuel tank internal pressure ftp is higher than the first target level of negative pressure ATftp1, then a decision is further made at step S150 as to whether the pressure reduction duration timer has counted up a specified pressure duration time Tpgon0. When the pressure reduction duration timer has not yet counted up the specified duration time Tpgon0, then the sequence logic orders return to step S138 to detect current driving conditions and repeats steps S139 through S150. On the other hand, when the fuel tank internal pressure ftp is equal to or lower than the first target level of negative pressure ATftp1 or when the pressure reduction duration timer has counted up the specified duration timer Tpgon0, the control logic proceeds to step S151 in FIG. 6E.

At step S151, a negative pressure holding timer is reset to an initial value of zero (Tpgof=0). Subsequently, after resetting a maximum fuel tank internal pressure ftprmax2 for jolt judgement to an initial level of zero (0) at step S152 and detecting current driving conditions at step S153, failure decision threshold values ASS1 and ASS2 for normality and abnormality judgements, respectively, are set up at step S154. As was previously described, the first threshold value ASS1 is greater than the second threshold value ASS2. Thereafter, after fully closing the purge control valve 35 at a point of time t6 so as thereby to keep the negative pressure in the evaporation control system at step S155 and causing the operation time counter to change the count Tst by an increment of one at step S156, a decision is made at step S157 as to whether the A-diagnostic mode conditions are all satisfied. When one or more of the A-diagnostic mode conditions are unsatisfied, then the sequence logic skips steps S158 through S173 and proceeds to step S174 without making both normality judgement and abnormality judgement. On the other hand, when the A-diagnostic mode conditions are all satisfied, after causing the negative pressure holding timer to change its count Tpgof by an increment of one at step S158, a decision is made at step S159 as to whether a fuel tank internal pressure ftp1 for reference value determination is detected at a specified time after the close-up of the purge control valve 35. In this instance, it is desirable to leave a certain length of pause before making the decision at step S159. When a fuel tank internal pressure ftp1 is detected or after treating a current fuel tank internal pressure ftp as the fuel tank internal pressure ftp1 at step S190 when a fuel tank internal pressure ftp1 is not yet detected, another decision is made at step S161 as to whether a fluctuation of liquid level ft1 in the fuel tank 21 is small. When the fluctuation of liquid level ft1 in the fuel tank 21 is small, the sequence logic proceeds to step S162 in FIG. 6F where a fuel tank internal pressure ftp is detected as the fuel tank internal pressure ftpr for jolt judgement. On the other hand, when the fluctuation of liquid level ft1 is not small, the sequence logic skips steps S162 through S173 and proceeds to step S174 without making both normality judgement and abnormality judgement.

After treating the fuel tank internal pressure ftp as the fuel tank internal pressure ftpr for jolt judgement at step S162, the maximum fuel tank internal pressure ftprmax2 for jolt judgement is renewed in the same manner as the maximum fuel tank internal pressure ftprmax1 at step S163. Subsequently, a decision is made at step S164 as to whether the count Tpgof of the negative pressure holding timer has exceeded a specified holding Tpgof0. When the count Tpgof of the negative pressure holding timer has not yet exceeded the specified holding Tpgof0, the sequence logic orders return to step S153. When the holding time Tpgof is greater than the specified holding Tpgof0, after treating the fuel tank internal pressure ftp as the fuel tank internal pressure ftp2 for reference value determination and storing the fuel tank internal pressure ftp2 in the memory of the control unit 100 at step S165, a reference value ARVftp is determined as a diagnostic criteria for evaporation control system failure diagnosis in the A-diagnostic mode by calulating the expression (I) at step S166. When the reference value ARVftp is determined, a decision is made at step S167 as to whether the reference value ARVftp is greater than the first threshold value ASS1 for abnormality judgement. In the case whether the reference value ARVftp is greater than the first threshold value ASS1, another decision is made at step S168 as to whether a rising rate of fuel tank internal pressure per unit time is greater than the maximum fuel tank internal pressure ftprmax2 for jolt judgement. In this instance, the rising rate of fuel tank internal pressure per unit time is given by the term "K(ftp2−ftp1)" of the expression (I) and otherwise defined as a gradient of a change in fuel tank internal pressure in a period of time from detection of the fuel internal pressure ftp1 to detection of the fuel tank internal pressure ftp2. It can be said that the gradient of a change in fuel tank internal pressure becomes greater than the maximum fuel tank internal pressure ftprmax2 for jolt judgement when there is a sharp rise in fuel tank internal pressure due to generation of a large amount of fuel vapors which is caused by jolts of the fuel tank. When the rising rate of fuel tank internal pressure per unit time is greater than the maximum fuel tank internal pressure ftprmax2, then a decision is further made at step S169 as to whether the maximum fuel tank internal pressure ftprmax1 for jolt judgement is lower than the specified maximum level of fuel tank internal pressure ftpmax0. This is nothing but a decision as to whether a rise in fuel tank internal pressure due to generation of a large amount of fuel vapors which is caused by jolts in a period of time between points of time t3 and t4 (see FIG. 3) is great or small. When the answer to the decision is affirmative, this indicates that there is no sharp rise in fuel tank internal pressure due to jolts of the fuel tank 21, then it is judged at step S170 that there is leakage of fuel vapors and the evaporation control system is abnormal in operation. On the other hand, when the reference value ARVftp is smaller than the first threshold value ASS1 at step S167, another decision is made at step S171 as to whether the reference value ARVftp is smaller than the second threshold value ASS2 for normality judgement. When the reference value ARVftp is smaller than the second threshold value ASS2, a decision is further made at step S172 as to whether the maximum fuel tank internal pressure ftprmax1 for jolt judgement is lower than the specified maximum level of fuel tank internal pressure ftpmax0. When the answer to the decision is affirmative, it is judged at step S173 that there is no leakage of fuel vapor and the evaporation control system is normal in operation. When judgement of abnormality or normality at step S170 or S173, the sequence logic orders return to the step of the general routine before the step called for the subroutine.

On the other hand, when the answer to the decision made at step S168, S169, S171 or S172 is negative, then the sequence logic proceeds directly to step S174 without making both normality judgement and abnormality judgement. That is, after causing the retrial counter to change its count Crt by an increment of one at step S174, a decision is made at step S175 as to whether the retrial counter has counted up a specified value Crt0. When the evaporation control system failure diagnosis in the A-diagnostic mode has not yet been repeated the specified number of times, the sequence logic repeats the control from step S105 after opening the atmosphere release valve 37 at step S110. On the other band, when the evaporation control system failure diagnosis in the A-diagnostic mode has been repeated the specified number of times, the sequence logic orders return to the step of the general routine after the step called for the subroutine.

FIGS. 7A to 7E are a flow chart illustrating a subroutine of the evaporation control system failure diagnosis in the B-diagnostic mode. When the sequence logic commences and control proceeds to a function block at step S201 where an ongoing time counter is reset to an initial value of zero (Tst=0). Subsequently after detecting current driving conditions at step S202, a decision is made at step S203 as to whether the engine has started operation. After waiting until the engine has started operation, a retrial counter is reset to an initial value of zero (Crt=0) at step S204 and a diagnosis frequency counter is reset to an initial value of zero (Cex=0) at step S204. This diagnosis frequency counter counts a diagnosis frequency necessary for detecting a pressure rise in the closed-up evaporation control system two tomes which is peculiar to the evaporation control system failure diagnosis in the B-diagnostic mode. Further after resetting the pressure reduction duration timer to an initial value of zero (Tpgon=0) at step S206, current driving conditions are detected at step S207. Then after causing the operation time counter to change the number of engine starts Tst by an increment of one at step S208, a decision is made at step S209 as to whether the B-diagnostic mode conditions are all satisfied. When the answer to the decision is negative, this indicates that one or more B-diagnostic mode conditions are unsatisfied, then after opening the atmosphere release valve 37 at step S213, the sequence logic orders return to step S206 through S208 for making another decision as to the B-diagnostic mode conditions. On the other hand, the answer to the decision is affirmative, this indicates that the B-diagnostic mode conditions are all satisfied, then after causing the pressure reduction duration timer to change the count Tpgon by an increment of one at step S210 and subsequently closing up the atmosphere release valve 37 at step S211, the purge control valve 35 is opened to reduce pressure in the evaporation control system at step S212.

Control of valve opening of the purge control valve 35 for pressure reduction is implemented through steps S214 to S217. That is, a decision is made at step S214 as to tile fuel tank internal pressure ftp is lower than a second specified level of negative pressure (second target level of negative pressure) BTftp2 (see FIG. 4). When the fuel tank internal pressure ftp is lower than the second target level of negative pressure BTftp2, the purge control valve 35 is caused to close by a specified valve opening Lx at step S215. On tile other hand, when the fuel tank internal pressure ftp is higher than the second target level of negative pressure BTftp2, then another decision is subsequently made at step S216 as to whether the purge control valve 35 has opened to its upper limit valve opening Npvo. When the purge control valve 35 remains open smaller than the upper limit valve opening Npvo, the purge control valve 35 is caused to open more by a specified valve opening Lx at step S2176. When the purge control valve 35 has opened exceeding the upper limit valve opening Npvo at step S216, or after changing the valve opening of the purge control valve 35 at step S215 or S217, a decision is subsequently made at step S218 as to whether the fuel tank internal pressure ftp is lower than a first specified level of negative pressure (a first target level of negative pressure) BTftp1 (see FIG. 4). When the fuel tank internal pressure ftp is higher than the first target level of negative pressure BTftp1, then a decision is further made at step S219 as to whether the pressure reduction duration timer has counted up a specified duration time Tpgon0. When the pressure reduction duration timer has not yet counted up the specified duration time Tpgon0, then the sequence logic orders return to step S207 to detect current driving conditions and repeats steps S207 through S218. On the other hand, when the fuel tank internal pressure ftp is lower than the first target level of negative pressure Tftp1 or when the pressure reduction duration timer has counted up the specified duration time Tpgon0, after resetting the negative pressure holding timer to an initial value of zero (Tpgof=0) and subsequently a maximum fuel tank internal pressure ftprmax for jolt judgement to an initial level of zero (0) at step S221, the purge control valve 35 is fully closed at a point of time t4 so as thereby to hold the negative pressure in the evaporation control system at step S222.

Thereafter, at step S223, the fuel tank internal pressure ftp at the time of closing the purge control valve 35 is stored as a fuel tank internal pressure ftp11 or ftp12 for reference value determination in the memory of the control unit 100. At step S224, a current atmospheric pressure, maximum and minimum atmospheric pressures having been detected up to the present are stored in the memory of the control unit 100. At the beginning of the evaporation control system failure diagnosis, the maximum and minimum atmospheric pressures are the same as the current atmospheric pressure. Subsequently, after detecting current driving conditions at step S225, a failure decision threshold value BSS for normality and abnormality judgements is set up at step S226. Thereafter, after causing the operation time counter to change the count Tst by an increment of one at step S227, a decision is made at step S228 as to whether the B-diagnostic mode conditions are all satisfied. When one or more of the B-diagnostic mode conditions are unsatisfied, then the sequence logic skips steps S229 through S255 and proceeds to step S256 without making both normality judgement and abnormality judgement. On the other hand, when the B-diagnostic mode conditions are all satisfied, after renewing the minimum and maximum atmospheric pressures at step S229 and subsequently causing the negative pressure holding timer to change its count Tpgof by an increment of one at step S230, a decision is made at step S231 as to whether a fluctuation of liquid level ft1 in the fuel tank 21 is large. When the fluctuation of liquid level ft1 in the fuel tank 21 is large, the sequence logic proceeds skips steps S232 through S255 and proceeds directly to step S256 without making both normality judgement and abnormality judgement. On the other hand, when the fluctuation of liquid level ft1 is not large, after treating the fuel tank internal pressure ftp as the fuel tank internal pressure ftpr for jolt judgement at step S232, the maximum fuel tank internal pressure ftprmax for jolt judgement is renewed In this instance, either one of a deviation between the current and last fuel tank internal pressures ftpr and the last maximum fuel tank internal pressure ftpmax that is stored in the memory of the control unit 100 that is greater than the other is treated as a renewed maximum fuel tank internal pressure ftpmax. Subsequently, a decision is made at step S234 as to whether the count Tpgof of the negative pressure holding timer has exceeded a specified holding time Tpgof0. When the count Tpgof of the negative pressure holding timer has not yet exceeded the specified holding time Tpgof0, the sequence logic orders return to step S225.

On the other hand, when the count Tpgof of the negative pressure holding timer has exceeded the specified holding time Tpgof0, after storing the fuel tank internal pressure ftp as a the fuel tank internal pressure ftp2 for reference value determination and causing the diagnosis frequency counter to change its count Cex by an increment of one at step S236, a decision is made at step S237 as to whether the diagnosis frequency counter has counted up a specified frequency Cex0 which is, for example in this embodiment, two. When the diagnosis frequency counter has not yet counted up the specified frequency Cex0, after resetting an interval timer to an initial value of zero (Cint=0) at a point of time t5 at step S238 and causing it to count time Cint at step S239, a decision is made at step S240 as to whether the interval timer has counted up a specified time Cint0. After waiting that the interval timer counts up the specified time Cint0, a pressure rise or pressure difference ΔP (=ftp2−ftp1) in fuel tank internal pressure while the fuel system remains closed up hermetically is determined at step S241 and stored as a preceding pressure rise ΔP1 in the memory of the control unit 100 at step S242üDThat is, the preceding pressure rise ΔP1 corresponds to a pressure difference between fuel tank internal pressures ftp21 and ftp11 shown in FIG. 4. Subsequently, at step S243, the current, maximum and minimum atmospheric pressures stored at step S224 are treated as preceding values, respectively, and stored in the memory of the control unit 100 at step S243.

On the other hand, when the diagnosis frequency counter has counted up the specified frequency Cex0 at step S237, a pressure rise or pressure difference ΔP (=ftp2−ftp1) in fuel tank internal pressure while the fuel system remains closed up hermetically is determined and stored in the memory of the control unit 100 at step S244üDThe pressure difference ΔP corresponds to a pressure difference between fuel tank internal pressures ftp22 and ftp21 shown in FIG. 4. Subsequently, a decision is made at step S245 as to whether the maximum fuel tank internal pressure ftpmax is less than KΔP (K is a control factor). When the maximum fuel tank internal pressure ftpmax is less than KΔP, then a decision is further made at step S246 as to whether the maximum fuel tank internal pressure ftpmax is less than KΔP1. When the maximum fuel tank internal pressure ftpmax is less than KΔP1, the sequence logic proceeds to a function block at step S247 in FIG. 6E. On the other hand, when the maximum fuel tank internal pressure ftpmax is greater than KΔP nor less than KΔP1, the sequence logic skips steps S247 through S255 and proceeds to step S256 without making both normality judgement and abnormality judgement.

After determining an absolute value of a difference ΔPP between ΔP1 and ΔP is determined at step S247, a decision is made at step S248 as to whether the difference ΔPP is smaller than a specified value ΔPP0 at step S249. When the difference ΔPP is greater than the specified value ΔPP0, the sequence logic skips steps S249 through S255 and proceeds to step S256 without making both normality judgement and abnormality judgement. On the other hand, when the difference ΔPP is smaller than the specified value ΔPP0, a reference value BRVftp is determined as a diagnostic criteria for evaporation control system failure diagnosis in the B-diagnostic mode by calculating the expression (II) at step S249. Subsequently, after setting a failure decision threshold value ASS1 at step S250, a decision is made at step S251 as to whether the reference value BRVftp is greater than the failure decision threshold value ASS1. When the reference value BRVftp is greater than the failure decision threshold value ASS1, it is considered that there is a high provability of leakage of fuel vapors, then a decision is made at step S252 as to whether a fluctuation of atmospheric pressure Fatpa is small. Specifically, when a difference between the minimum atmospheric pressure (which is one occurring in a period of time between point of times t14 and t15 for detection of fuel tank internal pressures ftp12 and ftp22 on the basis of which a pressure difference ΔP is calculated and the atmospheric pressure both of which have been stored in the memory at step S224 is smaller than a specified value, or when a difference between the minimum atmospheric pressure (which is one occurring in a period of time between point of times t4 and t5 for detection of fuel tank internal pressures ftp11 and ftp21 on the basis of which a pressure difference ΔP1 is calculated) and the atmospheric pressure both which have been stored in the memory at step S243 is smaller than a specified value, the fluctuation of atmospheric pressure Fatpa is judged as small. When the fluctuation of atmospheric pressure Fatpa is small, then it is judged at step S253 that there is leakage of fuel vapors and the evaporation control system is abnormal in operation. On the other hand, when the reference value BRVftp is smaller than the failure decision threshold value ASS1, a decision is made at step S254 as to whether a fluctuation of atmospheric pressure Fatpn is small. Specifically, when a difference between the maximum atmospheric pressure (which is one occurring in a period of time between point of times t14 and t15 for detection of fuel tank internal pressures ftp12 and ftp22 on the basis of which a pressure difference ΔP is calculated) and the atmospheric pressure both of which have been stored in the memory at step S224 is smaller than a specified value, or when a difference between the maximum atmospheric pressure (which is one occurring in a period of time between point of times t4 and t5 for detection of fuel tank internal pressures ftp11 and ftp21 on the basis of which a pressure difference ΔP1 is calculated) and the atmospheric pressure both which have been stored in the memory at step S243 is smaller than a specified value, the fluctuation of atmospheric pressure Fapn is judged as small. When the fluctuation of atmospheric pressure Fapn is small, then it is judged at step S255 that there is no leakage of fuel vapors and the evaporation control system is normal in operation. When judgement of abnormality or normality at step S170 or S173, the sequence logic orders return to the step of the general routine before the step called for the subroutine.

On the other hand, when the maximum fuel tank internal pressure ftpmax is less than KΔP1 at step S245, when the maximum fuel tank internal pressure ftpmax is greater than KΔP nor less than KΔP1 at step S246, when one or more of the B-diagnostic mode conditions are unsatisfied at step S228, when the fluctuation of liquid level ft1 in the fuel tank 21 is large at step S231, or when the fluctuation of atmospheric pressure Fapa or Fapn is large at step S252 or S254, then the sequence logic proceeds directly to step S256 without making both normality judgement and abnormality judgement. That is, after causing the retrial counter to change its count Crt by an increment of one at step S256, a decision is made at step S257 as to whether the retrial counter has counted up a specified value Crt0 which is, for example in this embodiment, three. When the evaporation control system failure diagnosis in the B-diagnostic mode has not yet been retried the specified number of times, the sequence logic repeats the control from step S206 after opening the atmosphere release valve 37 at step S213. On the other hand, when the evaporation control system failure diagnosis in the B-diagnostic mode has been repeated the specified number of times, the sequence logic orders return to the step of the general routine after the step called for the subroutine.

FIGS. 8A to 8F are a flow chart illustrating a subroutine of the evaporation control system failure diagnosis in the C-diagnostic mode. The evaporation control system failure diagnosis in the C-diagnostic mode is basically similar to the subroutine of the evaporation control system failure diagnosis in the B-diagnostic mode and, however, different in the following point in connection with judgement of large leakage of fuel vapors. In the B-diagnostic mode, poor or wrong introduction of negative pressure that causes insufficient pressure reduction in the evaporation control system is judged during pressure reduction process. Wrong introduction of negative pressure occurs also when two or more valves 34 are blocked due to a liquid level inclination in the fuel tank 21. If there is a possibility of an occurrence of such an inclination of liquid level in the fuel tank 21, the judgement of wrong negative pressure introduction is not implemented. Specifically, the evaporation control system failure diagnosis in the C-diagnostic mode is adapted to evade the judgement of large leak of fuel vapors when detecting all of the conditions that the fuel tank internal pressure is higher than a specified level of pressure, that a time for which negative pressure is drawn is too short (which occurs due to a location of the pressure sensor S1 for detecting a fuel tank internal pressure between the fuel tank 21 and the canister 30), and that the amount of liquid fuel remaining in the fuel tank 21 is larger than a specified amount. A threshold value for the judgement of wrong negative pressure introduction is determined on the basis of a basic value and a correction value which is calculated using a time after an engine start as a parameter.

The evaporation control system failure diagnosis in the C-diagnostic mode is implemented on the condition that the throttle valve 7 remains open less than a specified opening. This specific opening is changed so as to become greater with a fall in the atmospheric pressure, i.e. a rise in altitude. However, the evaporation control system failure diagnosis in the C-diagnostic mode is implemented on the condition that the throttle valve 7 remains open greater than the specified opening for the duration of a sufficiently short period of time. Further, while the evaporation control system failure is diagnosed on the basis of a result of a comparison of a pressure difference ($\Delta P$=ftp2−ftp1) after the holding of negative pressure with a threshold value in the C-diagnostic mode like in the B-diagnostic mode, however, this pressure difference is taken into consideration only once in the C-diagnostic mode differently in the B-diagnostic mode.

The following description will be made on the premise of what is described above and directed to steps of the flow chart or processes that are peculiar to the evaporation control system failure diagnosis in the C-diagnostic mode. In the following description, steps or processes of the evaporation control system failure diagnosis in the B-diagnostic mode are referred to as B-mode steps or B-mode processes, and similarly, steps or processes of the evaporation control system failure diagnosis in the C-diagnostic mode are referred to as C-mode steps or C-mode processes. In the flow chart illustrating the evaporation control system failure diagnosis in the C-diagnostic mode, C-mode process through steps S301 to S305 corresponds to the B-mode process through steps S201 to S206. In the process, because the pressure difference ($\Delta P$=ftp2−ftp1) after the holding of negative pressure is taken into consideration only once on the evaporation control system failure diagnosis, this C-mode process includes no step corresponding to the B-mode step S205. C-mode steps S306 and S307 are peculiar to the evaporation control system failure diagnosis in the C-diagnostic mode. When the throttle valve opening tvo that is detected together with an atmospheric pressure atp at step S306 is judged at step S307 to be greater than a specified valve opening Fatp that is determined on the basis of the atmospheric pressure atp as described above, after detecting driving conditions at step S308 which corresponds to the B-mode step S207, a basic threshold value SLbase for judgement of wrong negative pressure introduction is determined at step S309 which is peculiar to the C-diagnostic mode. Following to C-mode steps S310 and S311 corresponding to B-mode steps S208 and S209, respectively, a decision is made at step S313 whether a reference value ftpstp for evasion of the judgement of large leakage of fuel vapors has been determined. If not, a fuel tank internal pressure ftp is treated as a reference value ftpstp at step S314. C-mode process through C-mode steps S315 to S321 is corresponds to the B-mode process through B-mode steps S210 to S222 but C-mode process through steps S322 to S328 is peculiar to the evaporation control system failure diagnosis in the C-diagnostic mode. That is, when the throttle valve opening tvo is smaller than the specified valve opening Fatp at step S322, or on the condition that the duration of time Ttvd for which the throttle valve 7 remains open greater than the specified opening Fatp is shorter than a specified duration of time Ttvd0 at steps S323 through S324, the sequence logic proceeds to a decision at step S325. When the duration of time Ttvd is shorter than the specified duration of time Ttvd0, the sequence logic repeats the control from step S305 after opening the atmosphere release valve 37 at step S312. At step S325, a decision is made at step as to whether a fuel tank internal pressure ftp is lower than a specified level of pressure ftp0. When fuel tank internal pressure ftp is higher than the specified level of pressure ftp0, this indicates that the internal pressure of the fuel tank 31 is not sufficiently reduced, then another decision is subsequently made at step S326 as to whether the pressure reduction duration timer has counted up the specified duration time Tpgon0. When the pressure reduction duration timer has counted up the specified pressure reduction duration timer Tpgon0, then it is judged at step S327 that there is wrong negative pressure introduction and the sequence logic orders return to the step of the general routine after the step called for the subroutine without making both normality judgement and abnormality judgement. On the other hand, when the pressure reduction duration timer has not yet counted up the specified pressure reduction duration time Tpgon0, the sequence logic repeats control from step S306. Further when the fuel tank internal pressure ftp is lower than the specified level of pressure ftp0, a pressure reduction duration timer Tpgon counted up to the present is stored as a threshold value Tpgonstp for evading judgement of negative pressure introduction in the memory of the control unit 100 at step S328. C-mode process through steps S329 to S333 corresponds to the B-mode process through steps S220 to S224.

C-mode process through steps S334 to S339 is peculiar to the evaporation control system failure diagnosis in the C-diagnostic mode. Specifically, a correction value KTst (where K is a coefficient) for determining a threshold value for judgement of wrong negative pressure introduction is determined on the basis of an operation time Tst from an engine start so as to be larger as the operation time Tst becomes longer at step S334. Subsequently, an eventual threshold value SL2 is determined by adding the correction value eKTst (where e is a control constant) to the basic threshold value Lsbase at step S335. After detecting an amount of liquid fuel ft1stp remaining in the fuel tank 21 at step S336, a decision is made at step S337 as to whether conditions for evading the judgement of large leakage of fuel vapors are satisfied. As was previously described, the conditions include a fuel tank internal pressure ftp higher than a specified level of pressure, that a negative pressure drawing time shorter than a specified time, and an amount of liquid fuel remaining in the fuel tank 21 larger than a specified amount. When the large leakage judgement evading conditions are all satisfied, a decision is further made at step S338 as to whether the fuel tank internal pressure ftp2 is higher than the fuel tank internal pressure ftp1. When the fuel tank internal pressure ftp2 is lower higher than the fuel tank internal pressure ftp1, this indicates that there is wrong negative pressure introduction, then, it is judged at step S339 that there is wrong negative pressure introduction and the sequence logic orders return to the step of the general routine after the step called for the subroutine without making both normality judgement and abnormality judgement. On the other hand, when one or more of the large leakage judgement evading conditions are unsatisfied, or when the fuel tank internal pressure ftp2 is higher than the fuel tank internal pressure ftp1, the sequence logic implements C-mode process through steps S340 to S350 which corresponds to the B-mode process through steps S225 to S235.

Thereafter, the sequence logic implements C-mode process through S351 to S354 which is peculiar to the evaporation control system failure diagnosis in the C-diagnostic mode. At step S351, a decision is made as to whether the maximum fuel tank internal pressure ftpmax is smaller than K(ftp2−ftp1) (where K is a coefficient). When the maximum fuel tank internal pressure ftpmax is smaller than K(ftp2−ftp1), after determining a correction value KTst for determining a threshold value for judgement of wrong negative pressure introduction on the basis of an operation time Tst at step S352 and determining an eventual threshold value SL1 by adding the correction value KTst to an initial threshold value SS at step S353, a decision is made at step S354 as to whether an absolute value of a pressure difference between the fuel tank internal pressures ftp1 and ftp2 is greater than the threshold value SL1. Finally the sequence logic implements C-mode process through steps 355 to S360, which corresponds to the B-mode process through steps S252 to S257, to make normality judgement or abnormality judgement.

When one or more of the B-diagnostic mode conditions are unsatisfied at step S343, when the fluctuation of liquid level ft1 in the fuel tank 21 is large at step S346, or when the maximum fuel tank internal pressure ftpmax is greater than K(ftp2−ftp1) at step S351, the sequence logic proceeds directly to step S359 without making both normality judgement and abnormality judgement. That is, the retrial counter is caused to change its count Crt by an increment of one at step S359, and a decision is subsequently made at step S340 as to whether the retrial counter has counted up a specified value Crt0 which is, for example in this embodiment, three. When the evaporation control system failure diagnosis in the B-diagnostic mode has not yet been retried the specified number of times, the sequence logic repeats the control from step S305 after opening the atmosphere release valve 37 at step S312. On the other hand, when the evaporation control system failure diagnosis in the B-diagnostic mode has been retried the specified number of times, the sequence logic orders return to the step of the general routine after the step called for the subroutine.

It may be possible to define, conditions for implementation of the evaporation control system failure diagnosis, a specified region of engine speeds and engine loads for both B- and C-diagnostic modes and an ordinary driving state which exists within the specified region and in which changes of parameters that indicate driving conditions are small for the B-diagnostic mode (the ordinary driving state is excluded from the conditions for the C-diagnostic mode).

It will of course be appreciated that many modifications can be made within the scope of this invention provided that they can meet with the functional necessities of the invention

What is claimed is:

1. A system for diagnosing failures of an evaporation control system on the basis of a change in internal pressure of the evaporation control system that is closed up, said failure diagnosis system comprising:

pressure introduction means or introducing pressure, negative or positive, into the evaporation control system;

pressure detecting means for detecting an internal pressure of the evaporation control system; and control means for repeating a diagnostic process arranged to cause said pressure introduction means to introduce pressure into said evaporation control system and to close up said evaporation control system hermetically so as to define a diagnostic period, detect a change between said internal pressures detected at same timings, respectively, in said diagnostic period, and making a judgement that the evaporation control system causes leakage of fuel vapor on the basis of a mean value of a plurality of said changes detected in a plurality of said diagnostic periods.

2. A system for diagnosing failures of an evaporation control system as defined in claim 1, wherein said control means further evades said judgement when a difference between said changes is greater than a specified value.

3. A system for diagnosing failures of an evaporation control system as defined in claim 1, wherein said control means implements said judgement on condition that the vehicle travels in an ordinary driving condition in which changes in parameters relating to driving conditions are small.

4. A system for diagnosing failures of an evaporation control system as defined in claim 1, wherein said control means implements a first failure diagnosis for the evaporation control system in a specified region that is defined with at least engine speed and engine load as parameters and a second failure diagnosis for the evaporation control system in said specified region, on condition that the vehicle travels in an ordinary driving condition in which changes in said parameters are small, and further evades implementation of said second failure diagnosis only.

5. A system for diagnosing failures of an evaporation control system as defined in claim 4, wherein said first failure diagnosis is a diagnosis for large leakage of fuel vapors of the evaporation control system and said second failure diagnosis is a diagnosis for small leakage of fuel vapors of the evaporation control system.

6. A for diagnosing failures of an evaporation control system as defined in claim 4, wherein control means implements said first failure diagnosis on the basis of only one of said changes in internal pressure of the evaporation control system and said second failure diagnosis on the basis of a plurality of said changes in internal pressure of the evaporation control system.

7. A system for diagnosing failures of an evaporation control system as defined in claim 1, wherein said control means implements a first failure diagnosis on the basis of only one of said changes in internal pressure of the evaporation control system during engine idling on condition that an amount of fuel vapors generated before introducing pressure into the evaporation control system is small and a second failure diagnosis on the basis of a plurality of said changes in internal pressure of the evaporation system during engine off-idling.

8. A system for diagnosing failures of an evaporation control system on the basis of a change in internal pressure of the evaporation control system that is closed up hermetically with negative or positive pressure introduced therein, said failure diagnosis system comprising:

first failure diagnosis means for implementing a first failure diagnosis of large leakage of fuel vapors of the evaporation control system when a first failure diagnostic condition for implementation of said first failure diagnosis of large leakage which is predetermined on the basis of at least parameters regarding engine operation is satisfied; and second failure diagnosis means for implementing a second failure diagnosis of small leakage of fuel vapors of the evaporation control system when a second failure diagnostic condition for said first failure diagnosis of small leakage which is stricter than said first diagnostic condition is satisfied.

9. A system for diagnosing failures of an evaporation control system as defined in claim 8, and further comprising:

pressure introduction means for introducing pressure, negative or positive, into the evaporation control system;

pressure detecting means for detecting a change in internal pressure of the evaporation control system while the evaporation control system is closed up hermetically by closing said pressure introduction means; and control means for causing said pressure introduction means to introduce pressure into said evaporation control system and close up said evaporation control system hermetically, causing said first failure diagnosis means to implement said first failure diagnosis of large leakage of fuel vapors of the evaporation control system in a specified region that is defined with at least engine speed and engine load as parameters when said first diagnostic condition is satisfied, and causing said second failure diagnosis means to implement said second failure diagnosis of small leakage of fuel vapors of the evaporation control system in said specified region on condition that the vehicle travels in an ordinary driving condition in which changes in said parameters are small when a second diagnostic condition which is determined on the basis of said parameters is satisfied.

10. A system for diagnosing failures of an evaporation control system as defined in claim 8, wherein each of said first and second failure diagnoses is implemented on condition that a specified fuel condition relating to an amount of liquid fuel remaining in a fuel tank is satisfied, and said specified fuel condition is determined so that said second failure diagnosis is harder to be implemented than said first failure diagnosis.

11. A system for diagnosing failures of an evaporation control system as defined in claim 8, wherein control means implements said first failure diagnosis on the basis of said change in internal pressure of the evaporation control system and said second failure diagnosis on the basis of a plurality of said changes in internal pressure of the evaporation control system.

12. A system for diagnosing failures of an evaporation control system as defined in claim 8, wherein each of said first and second failure diagnoses is implemented on condition that a specified fuel condition relating to an amount of liquid fuel remaining in a fuel tank is satisfied; and said specified fuel condition is determined so that said second failure diagnosis is harder to implement than said first failure diagnosis.

13. A for diagnosing failures of an evaporation control system as defined in claim 8, wherein said control means implements said failure diagnosis for the evaporation control system during engine off-idling.

14. A system for diagnosing failures of an evaporation control system on the basis of a change in internal pressure of the evaporation control system that is closed up, said failure diagnosis system comprising:

pressure introduction means for introducing pressure, negative or positive, into the evaporation control system;

pressure detecting means for detecting a change in internal pressure of the evaporation control system; and control means arranged to repeatedly cause said pressure introduction means to introduce pressure into said evaporation control system, and close up said evaporation control system hermetically, said control means making a judgement that the evaporation control system causes leakage of fuel vapor on the basis of a plurality of said changes in internal pressure of the evaporation control system, wherein said control means further evades said judgement when a difference between said changes is greater than a specified value.

15. A system for diagnosing failures of an evaporation control system on the basis of a change in internal pressure of the evaporation control system that is closed up, said failure diagnosis system comprising:

pressure introduction means for introducing pressure, negative or positive, into the evaporation control system;

pressure detecting means for detecting a change in internal pressure of the evaporation control system; and control means arranged to repeatedly cause said pressure introduction means to introduce pressure into said evaporation control system, and close up said evaporation control system hermetically, said control means making a judgement that the evaporation control system causes leakage of fuel vapor on the basis of a plurality of said changes in internal pressure of the evaporation control system, wherein said control means implements a first failure diagnosis for the evaporation control system in a specified region that is defined with at least engine speed and engine load as parameters and a second failure diagnosis for the evaporation control system in said specified region, on condition that the vehicle travels in an ordinary driving condition in which changes in said parameters are small, and further evades implementation of said second failure diagnosis only.

16. The system of claim 15 wherein said first failure diagnosis is a diagnosis for large leakage of fuel vapors of the evaporation control system and said second failure diagnosis is a diagnosis for small leakage of fuel vapors of the evaporative control system.

17. The system of claim 15 wherein the control means implements said first failure diagnosis on the basis of only one of said changes in internal pressure of the evaporation control system and said second failure diagnosis on the basis of a plurality of said changes in internal pressure of the evaporation control system.

* * * * *